US008454133B2

(12) United States Patent
Mizukami et al.

(10) Patent No.: US 8,454,133 B2
(45) Date of Patent: Jun. 4, 2013

(54) INKJET HEAD, INKJET RECORDING APPARATUS, LIQUID DROPLET EJECTING APPARATUS, AND IMAGE FORMING APPARATUS

(75) Inventors: Satoshi Mizukami, Kanagawa (JP); Masaki Kato, Tokyo (JP); Takahiko Kuroda, Hyogo (JP); Kanshi Abe, Kanagawa (JP); Yoshikazu Akiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/422,136

(22) Filed: Mar. 16, 2012

(65) Prior Publication Data

US 2012/0236083 A1 Sep. 20, 2012

(30) Foreign Application Priority Data

Mar. 18, 2011 (JP) ..... 2011-061637

(51) Int. Cl.
*B41J 2/045* (2006.01)

(52) U.S. Cl.
USPC ..... 347/70; 347/68; 347/71; 347/72

(58) Field of Classification Search
USPC ..... 347/68, 70–72
See application file for complete search history.

(56) References Cited

U.S. PATENT DOCUMENTS

| | | | |
|---|---|---|---|
| 7,559,631 | B2 | 7/2009 | Shimada et al. |
| 2011/0090289 | A1 | 4/2011 | Mizukami |

FOREIGN PATENT DOCUMENTS

| | | |
|---|---|---|
| JP | 2004-154987 | 6/2004 |
| JP | 2008-155430 | 7/2008 |
| JP | 4371209 | 9/2009 |
| JP | 2009-226794 | 10/2009 |
| JP | 2010-42683 | 2/2010 |

*Primary Examiner* — Matthew Luu
*Assistant Examiner* — Henok Legesse
(74) *Attorney, Agent, or Firm* — Cooper & Dunham LLP

(57) ABSTRACT

An inkjet head is disclosed. In the inkjet head a vibrating plate is formed on a liquid chamber substrate on which multiple dedicated liquid chambers are aligned; a first insulating film and a second insulating film are formed between a dedicated electrode wiring and a lower electrode in an area in which the dedicated electrode wiring and the lower electrode overlap; a third insulating film and a fourth insulating film are stacked in an area which includes a forming area of the dedicated electrode wiring; in at least a portion of a forming area of the dedicated liquid chamber, there is provided a non-film forming area; and, in an area including a piezoelectric element forming section, either the first insulating film and the fourth insulating film are formed in the non-film forming area, or the fourth insulating film is formed in the non-film forming area.

17 Claims, 15 Drawing Sheets

INKJET HEAD, INKJET RECORDING APPARATUS, LIQUID DROPLET EJECTING APPARATUS, AND IMAGE FORMING APPARATUS

TECHNICAL FIELD

The present invention generally relates to inkjet heads, inkjet recording apparatuses, liquid droplet ejecting apparatuses, and image forming apparatuses, and specifically relates to image forming apparatuses; and inkjet heads, inkjet recording apparatuses, and liquid droplet ejecting apparatuses for use in the image forming apparatuses such as printing machines including a copying machine, a facsimile machine, a printer, a plotter, and a screen printing machine; and multi-functional machines which include multiple of the above-described functions.

BACKGROUND ART

As a technique to increase a density of an inkjet head using a piezoelectric element, a technique is known and embodied which applies a micro electromechanical system (below abbreviated as "MEMS"). In other words, a semiconductor device manufacturing technique may be applied and an actuator and a liquid flow path may be minutely formed to increase a nozzle density, making it possible to realize a reduced size and an increased density of the head.

In the inkjet head adopting such an MEMS technique, using photolithography, an electrode and a piezoelectric material which are formed with a thin-film forming technique may be patterned on a vibrating plate which is formed with a thin-film technique, and a piezoelectric element may be formed to make an actuator. In this case, the piezoelectric element is patterned using a semiconductor process, so that a thickness of the piezoelectric material is limited to a few micrometers at the most. Moreover, for etching or forming of a wiring electrode or an insulator film needed for a device, or an electrode which forms the piezoelectric element, a process using plasma, i.e., a plasma CVD, dry etching, etc., is commonly used.

When the piezoelectric element (more specifically, when a below-described PZT, referring to "a solid solution of titanic acid ($PbTiO_3$) and lead zirconate ($PbTiO_3$)" or "lead zirconate titanate", is used as the material) is exposed to the above-described plasma process, the piezoelectric material is reduced by a reduction action of hydrogen, etc., which are generated during the process, so that the characteristics tend to deteriorate remarkably. Moreover, besides the above-described plasma process, it is commonly known that the characteristics of the piezoelectric material deteriorate due to moisture within the atmosphere.

As countermeasures for the above-described problems, techniques are being proposed which cover an end or the whole faces of the piezoelectric element with a protective layer (see Patent documents 1 and 2, for example).

Patent document 1 discloses a technique such that a piezoelectric element may be covered with an inorganic amorphous material to prevent penetration of moisture into a piezoelectric material, enhancing reliability of the piezoelectric material. Moreover, it discloses that, when extending a lead electrode formed on the inorganic amorphous material via a contact hole from an upper electrode and connecting to a drive circuit, an insulating film which is different from the above-described inorganic amorphous material is covered on the lead electrode, making it possible to use an electrode material such as Al (Aluminum), which tends to corrode. In this way, an inexpensive wiring material may be used. When the lead electrode is drawn around the inorganic amorphous material, a layout may be adopted such that it overlaps a lower electrode (common electrode).

On the other hand, Patent document 2 discloses a technique such that, in an insulating film formed on a piezoelectric element, an inorganic material layer and an organic material layer are stacked. In other words, an end of a piezoelectric material into which moisture tends to penetrate is covered with the inorganic material, while at the same time an opening is provided on an upper electrode, making it possible to suppress, to a minimum level, a drop in an amount of vibratory displacement due to a rigid inorganic material as well as to prevent moisture permeation at the same time. Moreover, the whole face of the piezoelectric element is covered with a soft organic material, making it possible to ensure reliability of a device.

Patent Document

Patent document 1: JP2010-042683A

Patent document 2: JP4371209B

However, with the technique disclosed in Patent document 1, as the whole pattern area face including the piezoelectric element is covered with the inorganic amorphous material, making a film thick remarkably obstructs a displacement of the piezoelectric element, causing the ejection characteristics to deteriorate considerably. On the other hand, making a thin film of the inorganic amorphous material in order to achieve a large amount of displacement of the piezoelectric element causes an inability to ensure withstand pressure between the lead electrode and the lower electrode. Therefore, there is a problem that, as it is necessary to provide an electrode layout such that an overlap of the lead electrode and the lower electrode does not occur, making a head small and highly dense becomes difficult, and, at the same time, a constraint occurs on a height of a junction with a protective substrate, making an enhancement of the junction quality difficult. In a device manufactured in a semiconductor process, making an element highly dense is an important problem since it affects manufacturing costs. In other words, this is because the number of chips cut out from a single wafer greatly affects the costs.

Also in the technique disclosed in Patent document 2, two layers of insulating films are formed on a piezoelectric material, causing a tendency for vibration hindrance to occur. Moreover, in order to ensure withstand pressure with the insulating film of an organic material, it is necessary to thicken the film relative to a general inorganic material and, at the same time, adhesion with an electrode material is poor, so that it is difficult to form a lead electrode on the organic material. Therefore, the lead electrode is formed between the organic material (insulating film) and the inorganic material (insulating film); however, as described above, with such a configuration, the lower electrode and the lead electrode cannot be overlapped as described above (or a film thickness of the inorganic material is needed such that an amount of displacement of the piezoelectric element drops remarkably), so that making a head highly dense becomes difficult.

DISCLOSURE OF THE INVENTION

In light of problems as described above, an object of the present invention is to prevent deterioration of a piezoelectric material due to moisture within the atmosphere and plasma in the above-described semiconductor (fabrication) process and increase an amount of displacement of a piezoelectric element and, at the same time, eliminate constraints of wiring of a dedicated electrode, etc., to realize and provide an injection head which may be made highly dense, or in other words, to realize and provide a small-sized injection head while maintaining high reliability (moisture resistance) and superior ejection characteristics. Moreover, another object of the present invention is to realize and provide an inkjet recording apparatus and a liquid droplet ejecting apparatus that have the inkjet head installed thereon, and an image forming apparatus which has the inkjet head, inkjet recording apparatus, or liquid droplet ejecting apparatus installed thereon.

According to an embodiment of the present invention, an inkjet head is provided, wherein a vibrating plate is formed on a liquid chamber substrate on which multiple dedicated liquid chambers are aligned, each one of the dedicated liquid chambers being partitioned from the respectively neighboring one of the dedicated liquid chambers by a partition wall, and wherein a piezoelectric element is formed on the side facing the dedicated liquid chambers on the vibrating plate, the piezoelectric element including a lower electrode, a piezoelectric material, and an upper electrode, the inkjet head to be pulled out to a drive signal input section with a dedicated electrode wiring which is in conductive communication with the upper electrode; wherein a first insulating film and a second insulating film are formed between the dedicated electrode wiring and the lower electrode at least in an area in which the dedicated electrode wiring and the lower electrode overlap; wherein a third insulating film and a fourth insulating film are stacked in an area which includes a forming area of the dedicated electrode wiring except the drive signal input section; wherein, in at least a portion of a forming area of the dedicated liquid chambers, there is provided a non-film forming area in which the second insulating film and the third insulating film are not formed, or in which the first insulating film and the second insulating film and the third insulating film are not formed; and wherein, in an area including a piezoelectric element forming section, either the first insulating film and the fourth insulating film are formed in the non-film forming area in which the second insulating film and the third insulating film are not formed, or the fourth insulating film is formed in the non-film forming area in which the first insulating film and the second insulating film and the third insulating film are not formed.

The present invention makes it possible to realize and provide a novel inkjet head, an inkjet recording apparatus, a liquid droplet ejecting apparatus, and an image forming apparatus that solves the above-described problems to achieve the above-described objects.

In other words, with the features as described above, embodiments of the present invention may prevent deterioration of a piezoelectric material due to moisture within the atmosphere and plasma in the above-described semiconductor process and increase an amount of displacement of a piezoelectric element and, at the same time, eliminate constraints of wiring of a dedicated electrode, etc., to realize and provide an injection head which may be made highly dense, or in other words, to realize and provide a small-sized injection head while maintaining high reliability (moisture resistance) and superior ejection characteristics.

Moreover, with the features as described above, embodiments of the present invention may realize and provide a high-quality inkjet recording apparatus with superior image quality with the inkjet head which provides the above-described advantages installed thereon, also contributing to a reduced size of the inkjet recording apparatus.

Furthermore, with the features as described above, embodiments of the present invention may realize and provide a high-quality liquid droplet ejecting apparatus with superior image quality with the inkjet head which provides the above-described advantages installed thereon, also contributing to a reduced size of the liquid droplet ejecting apparatus.

Moreover, with the features as described above, embodiments of the present invention may realize and provide a high-quality image forming apparatus with superior image quality with the inkjet recording apparatus or the liquid droplet ejecting apparatus which provides the above-described advantages installed thereon, also contributing to a reduced size of the image forming apparatus.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below, embodiments of the present invention (below-called "embodiment") of the present invention are described in detail with reference to the figures. For elements (parts, components, etc.) having the same function, shape, etc., over respective embodiments, examples, comparative examples, etc., the same letters are affixed, so that repeated explanations are omitted after having explained once unless there is a possibility of confusion. For brevity and clarity of the figures and explanations, even for those elements to be shown in a figure, elements which do not need specific explanations in the figure may be omitted as needed without any explanatory notes. For providing an explanation with reference to an element in a printed patent publication, etc., parentheses are provided to a letter thereof so as to distinguish it from that in the respective embodiments, etc.

An embodiment of the present invention is described with reference to FIGS. 1 to 3.

Figure 1:
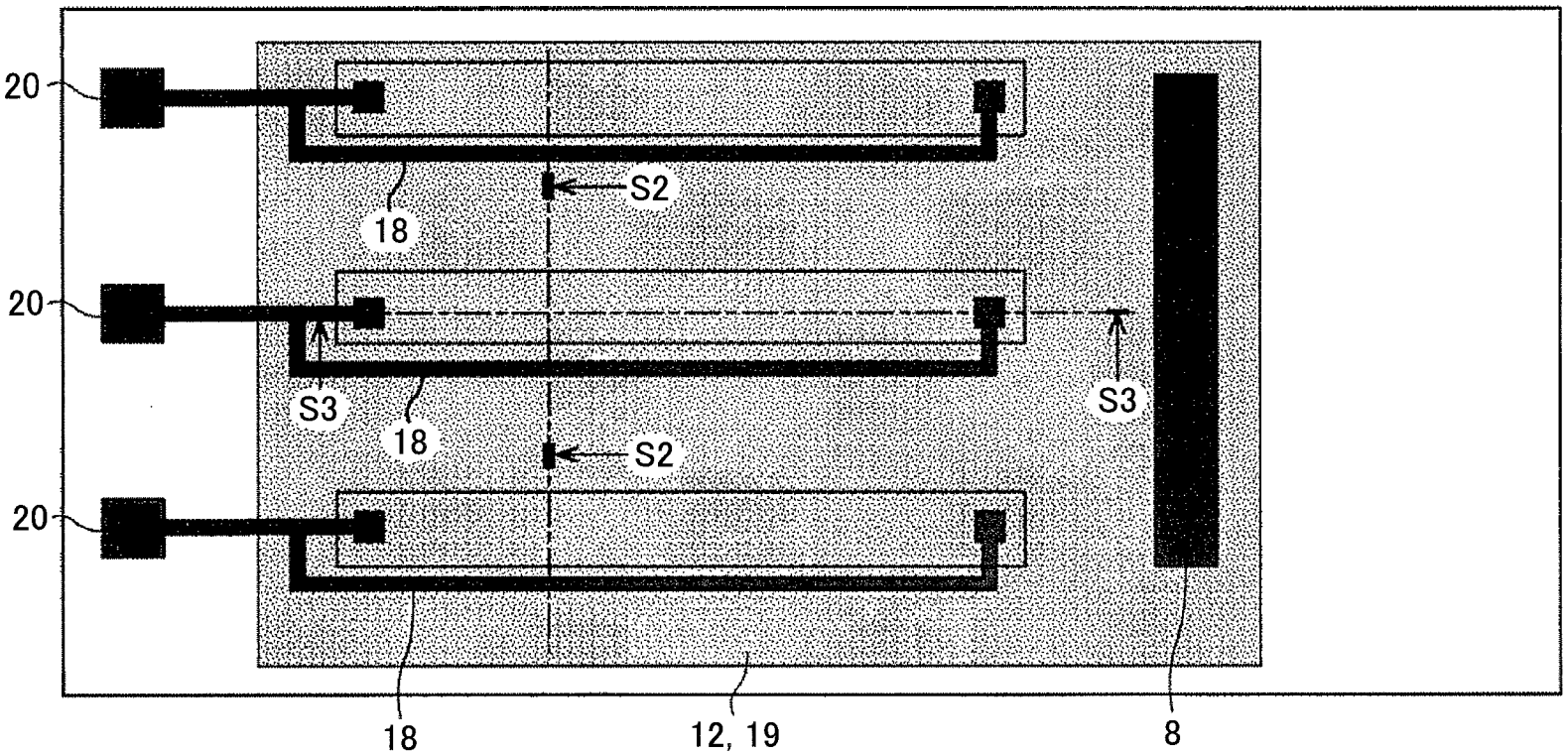
FIG. 1 is a plan view of an inkjet head according to one embodiment of the present invention.

FIG. 1 is a plan view of an inkjet head according to one embodiment of the present invention; FIG. 2 is an S2-S2 cross-sectional diagram of the inkjet head in FIG. 1; and FIG. 3 is an S3-S3 cross-sectional diagram of the inkjet head in FIG. 1.

In FIG. 1 are shown a lead wiring 18, a liquid chamber area 19, and a drive signal input section for a dedicated electrode wiring 20.

Figure 2:
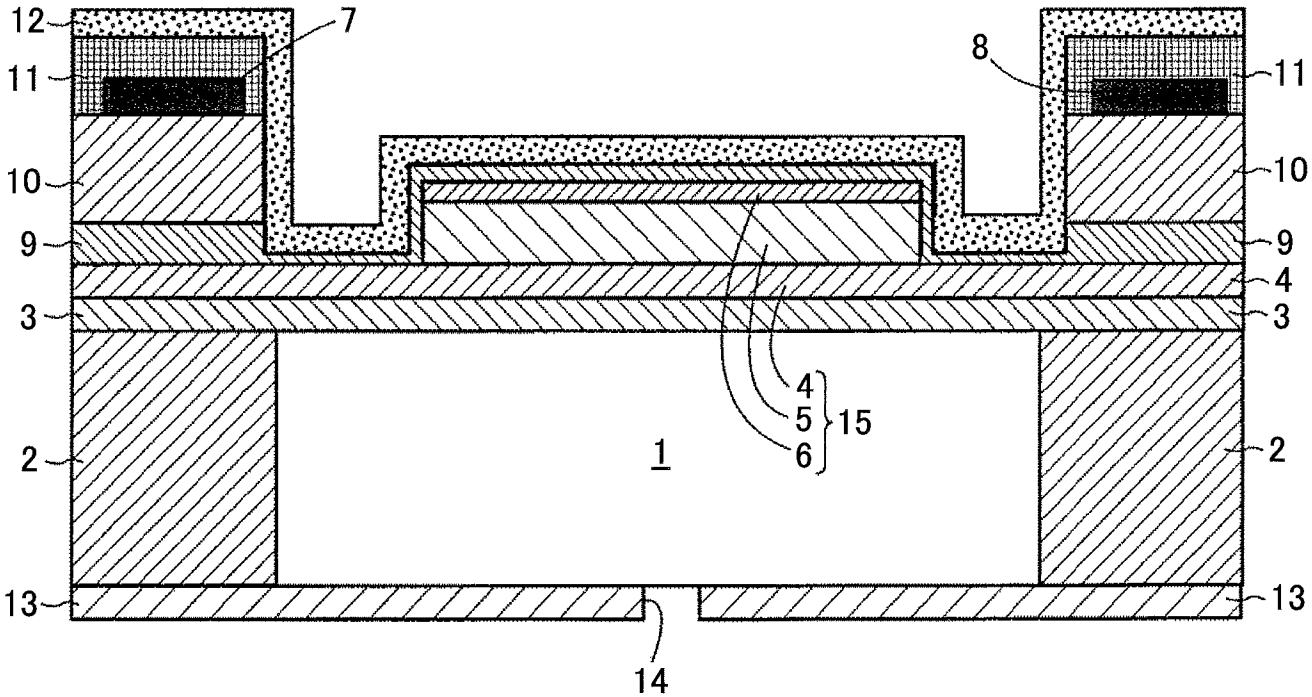
FIG. 2 is an S2-S2 cross sectional diagram of the inkjet head in FIG. 1.

While only a single dedicated liquid chamber 1 is shown in FIG. 2, a structure is adopted which has the dedicated liquid chambers aligned in a lateral direction of FIG. 2. In other words, a structure is adopted in which the dedicated liquid chambers 1 are aligned such that they are partitioned by a liquid chamber substrate 2 which is a partition wall shown in FIG. 2. While an arbitrary material may be used for a material of the liquid chamber substrate 2, it is preferable to use an Si substrate. When using the Si substrate, a so-called semiconductor fabrication process may be used for processing by photolithography and etching, making it possible to make alignment of the dedicated liquid chambers 1 highly dense.

Figure 3:
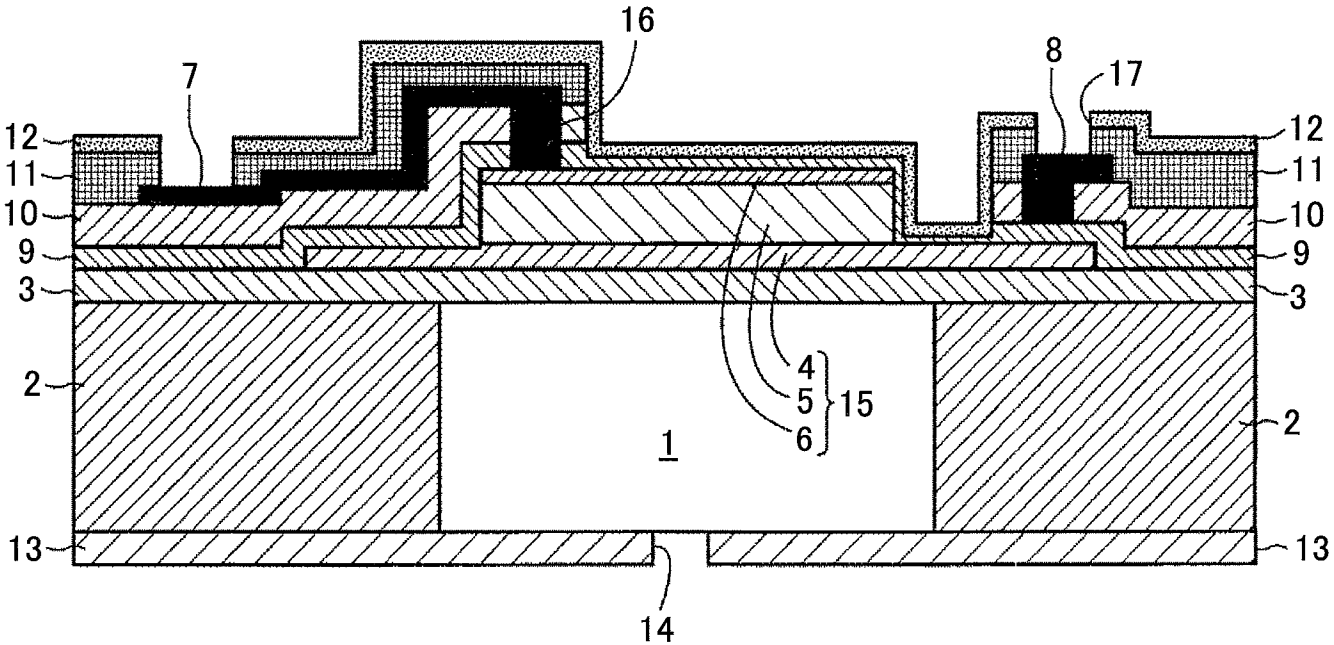
FIG. 3 is an S3-S3 cross sectional diagram of the inkjet head in FIG. 1.

As shown in FIGS. 2 and 3, a piezoelectric element 15 which includes a lower electrode 4, a piezoelectric material 5, and an upper electrode 6; and a vibrating plate 3 are formed at an upper portion of the dedicated liquid chamber 1. Applying voltage to the upper electrode 6 and the lower electrode 4 causes stress to be exerted on the vibrating plate 3 and deforms the vibrating plate 3. In this way, it becomes possible to cause a volume change in the dedicated liquid chamber 1. Moreover, a nozzle plate 13 which has a nozzle 14 is affixed to a bottom face of the dedicated liquid chamber 1, the dedicated liquid chamber 1 is filled up with liquid (ink), and a voltage is applied, thereby causing pressure to be generated due to a displacement of the vibrating plate 3 and causing the liquid (the ink) to be ejected from the nozzle 14.

Below, functions of four types of insulating films formed over the upper electrode 6 are described in detail. As shown in FIGS. 2 and 3, an insulating film 9 as a first insulating film is an insulating film which covers the whole face of the substrate including a piezoelectric element 15. The insulating film 9, which is provided with openings (below called merely an opening) as non-film forming areas only at a common electrode contact hole 17 for taking out a common electrode from the lower electrode 4 and a dedicated electrode contact hole 16 for taking out a dedicated electrode from the upper electrode 6, is structured to cover the other vibrating plate 3 forming portion. The insulating film 9 has a function of protecting the piezoelectric element 15 which includes the lower electrode 4, the piezoelectric material 5, and the upper electrode 6.

As shown in FIGS. 2 and 3, an insulating film 10 as a second insulating film, which is formed, together with the insulating film 9, between a dedicated electrode wiring 7 shown painted in black and the lower electrode 4 in an area in which the dedicated electrode wiring 7 and the lower electrode overlap each other, has a function as an interlayer protective layer for protecting from shorting between the dedicated electrode wiring 7 and the lower electrode 4. A dedicated liquid chamber forming area is provided with an opening (a non-film forming area) other than the dedicated electrode and the common electrode contact holes 16 and 17 in order to increase the displacement of the piezoelectric element 15.

As shown in FIGS. 1-3, an insulating film 11 as a third insulating film that is shown with a meshed design, which is formed in an area which includes a dedicated electrode wiring forming area except a drive signal input section 20, has a function, of protecting the dedicated electrode wiring 7 or the common electrode wiring 8. Similar to the insulating film 10, the dedicated liquid chamber forming area is provided with an opening in order to increase the displacement of the piezoelectric element 15.

As shown in FIGS. 1-3, an insulating film 12 as a fourth insulating film that is shown with a crepe weave design, which is formed in an area which includes a dedicated electrode wiring forming area except a drive signal input section 20, has a function, besides protecting the dedicated electrode wiring 7 or the common electrode wiring 8, similar to the insulating film 11, of protecting the piezoelectric element 15 which includes the lower electrode 4, the piezoelectric material 5, and the upper electrode 6, similar to the insulating film 9.

Here, a flow of a process of fabricating the respective insulating films is described with reference to FIGS. 4A to AC and 5A to 5C. This process flow includes six steps shown in FIGS. 4A to 4C and FIGS. 5A to 5C.

Figure 4A:
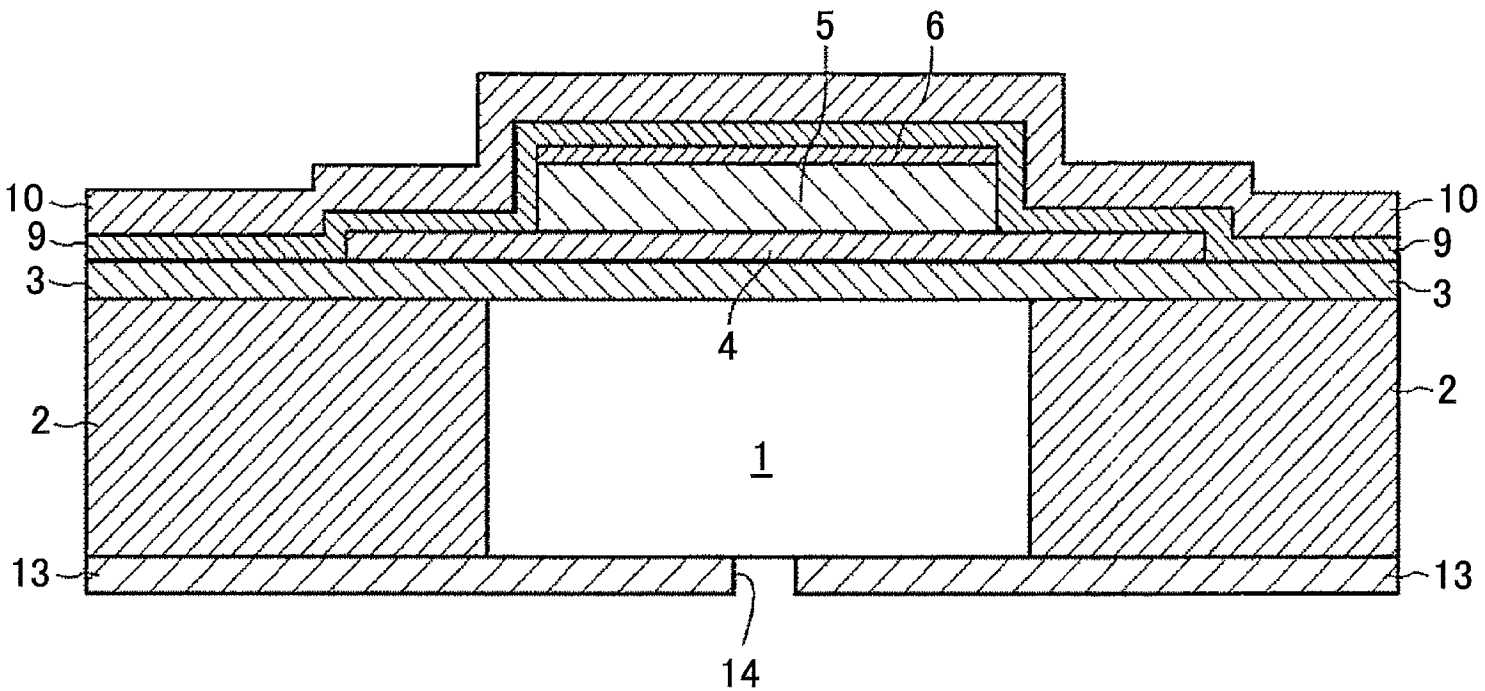
FIGS. 4A to 4C are cross-sectional diagrams of a main part for explaining a flow of a process for fabricating the respective insulating films in FIGS. 1 and 2.
Figure 4B:
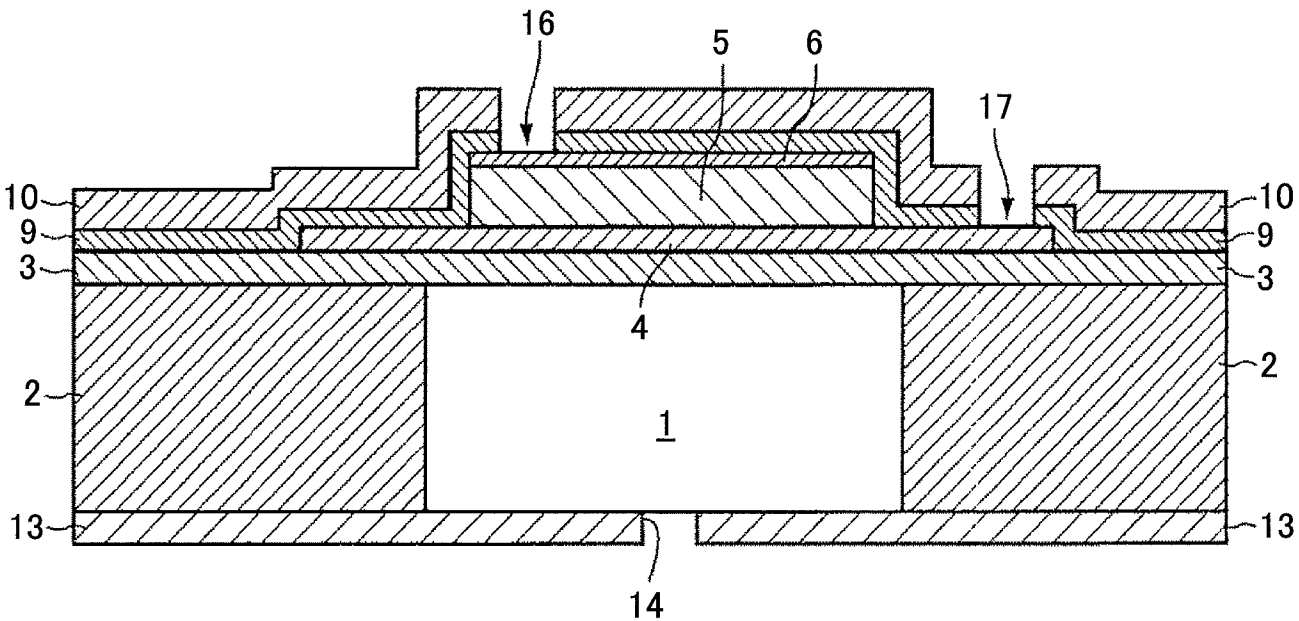
Figure 4C:
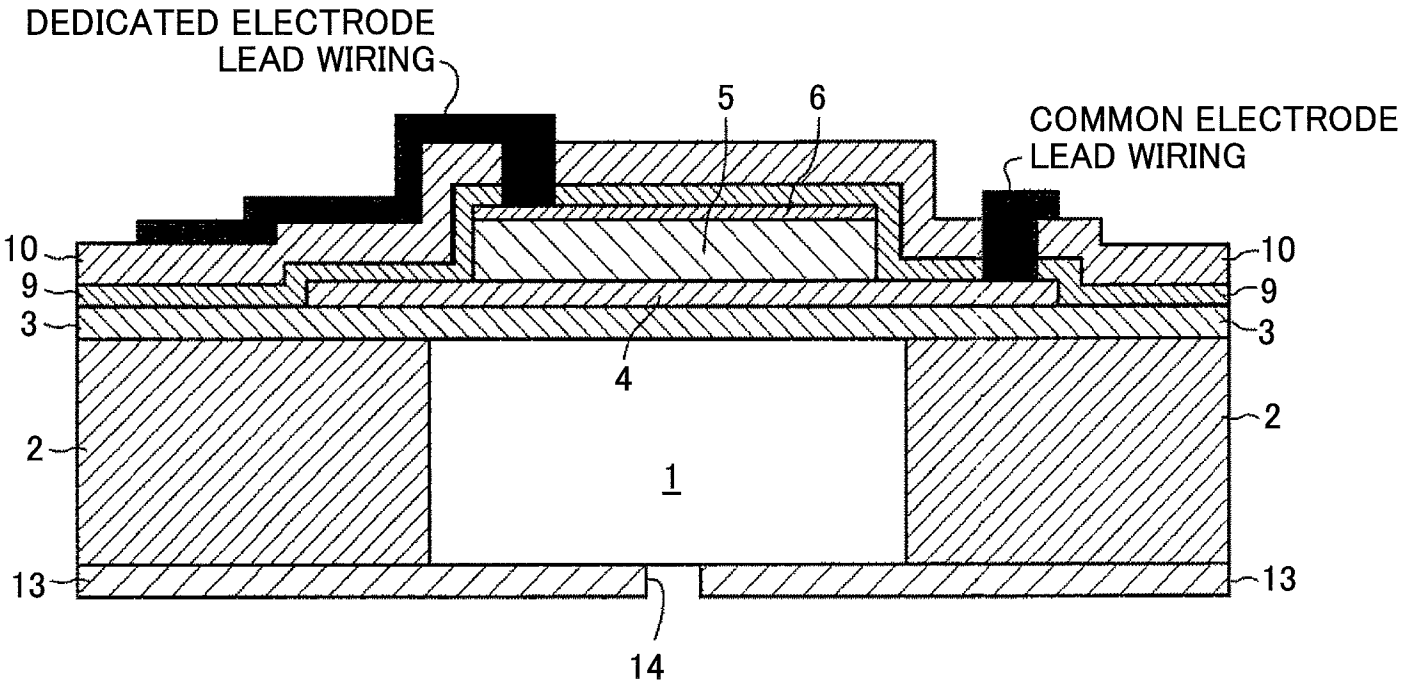
Figure 5A:
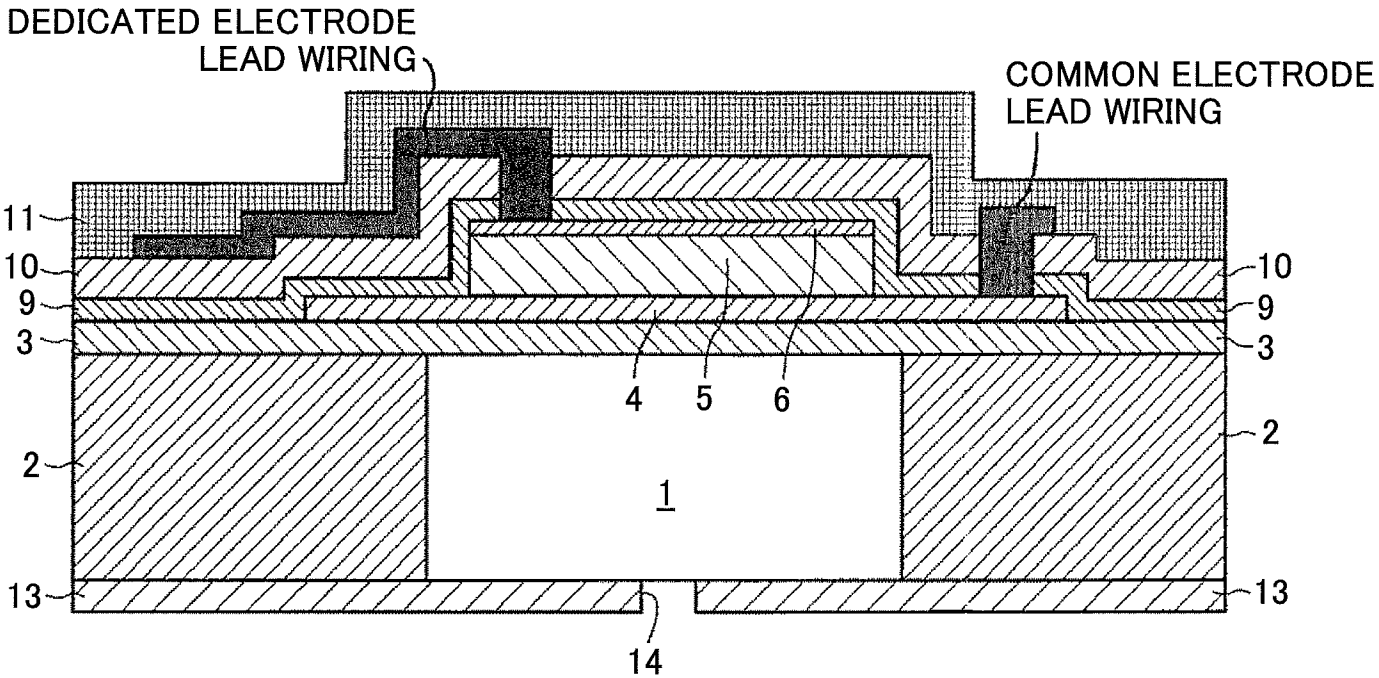
FIGS. 5A to 5C are cross-sectional diagrams of a main part for explaining a continuation of a flow of a process in FIGS. 4A to 4C.
Figure 5B:
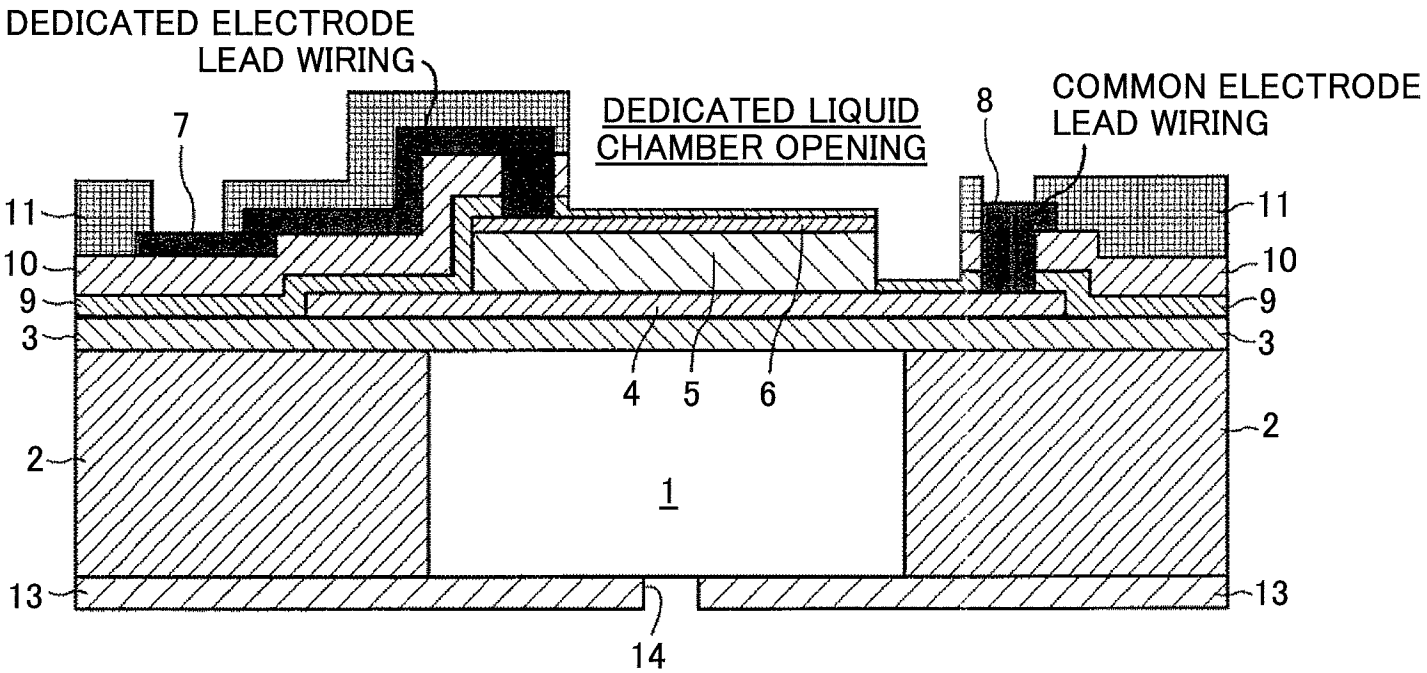
Figure 5C:
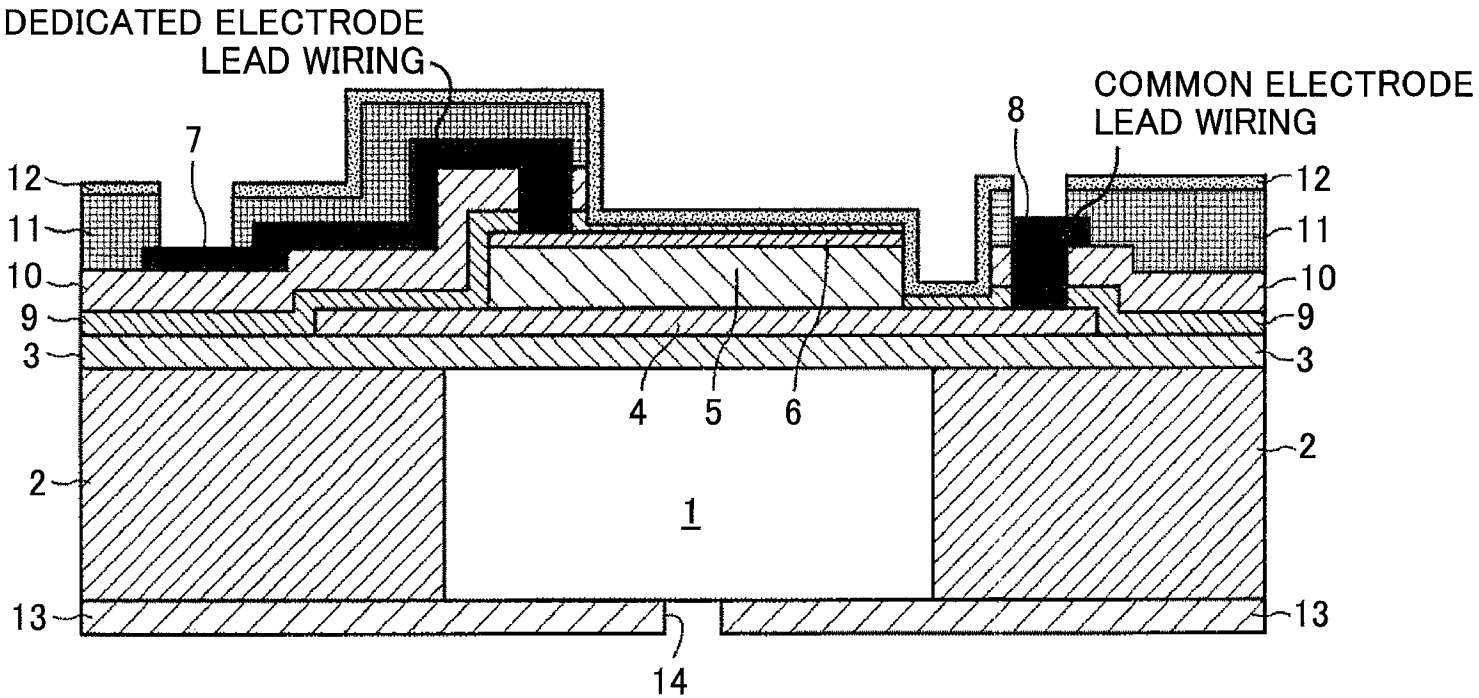

After the insulating film 9 and the insulating film 10 are formed (a first step) as shown in FIG. 4A, the dedicated electrode contact hole 16 and the common electrode contact hole 17 are formed by etching (a second step) as shown in FIG. 4B. Then, after undergoing a film forming of the wiring electrode and a pattern forming by etching (a third step) as shown in FIG. 4C, the insulating film 11 is formed (a fourth step) as shown in FIG. 5A. Then, in order to provide an opening in the dedicated liquid chamber forming area as shown in FIG. 5B, the insulating film 11 and the insulating film 10 undergo consecutive etching, so that a dedicated liquid chamber opening is formed (a fifth step). At this time, a film thickness of the insulating film 9 becomes small due to over-etching, and at the same time the insulating film 9 may experience a damage due to etching. Then, the insulating film 12, which is formed as shown in FIG. 5C, is formed such that it is provided with openings at a PAD section 12*a* for taking out the dedicated electrode wiring 7 and a PAD section 12*b* for taking out the common electrode wiring 8, as shown in FIGS. 2 and 3 (a sixth step).

There are two types of factors which damage the piezoelectric element 15: a factor due to a manufacturing process and a factor due to an environment in which a device is used. The above-described insulating film configuration is a configuration such that it can deal with the below-described two factors.

A first factor (factor due to the manufacturing process) includes a damage to the piezoelectric element 15 due to film forming and etching processes. For making the inkjet head, there are processes of forming and patterning the insulating film 11 (a wiring protective layer) which protects a wiring material and the insulating film 10 (an interlayer insulating film) which insulates the wiring layer and the electrode after forming the piezoelectric element 15. While film forming of such materials requires use of sputtering, plasma CVD, etc., the plasma causes a piezoelectric element 15 to be damaged. For the mechanism, there is a description (the upper electrode 6: $Ir/IrO_2$, the piezoelectric material 5: PZT) in a part of a ferrodielectric memory advanced process, which is described below:

(1) When $SiO_2$, SiN, etc., are used for the insulating film, hydrogen is generated from a material to be a raw material, which generated hydrogen penetrates into the upper electrode film, reducing $IrO_2$ to generate metal Ir.

(2) This metal Ir dissociates a hydrogen molecule by catalytic action to generate a hydrogen radical.

(3) The generated hydrogen radical penetrates into a PZT lattice, and bonds with oxygen.

(4) As a result, the movement of an electric dipole is sealed, inhibiting polarization reversal of the whole domain.

Moreover, based on our experience, it has been confirmed that, besides the above-described mechanism, when forming a film of SiN by the plasma CVD, $NH_3$ itself, which $NH_3$ is to be a raw material, generates the hydrogen radical, which itself is damaging PZT.

A second factor (the factor being the environment in which the device is used) is moisture within the atmosphere. In particular, an inkjet device which uses water based ink tends to be exposed to a high moisture environment, so a failure occurs such that the moisture within the atmosphere of the device is taken into the piezoelectric material, damaging the device. As a result, poor electric discharge occurs due to deterioration of withstand pressure of the piezoelectric element. In other words, an inkjet head with a low drive durability is yielded.

The insulating film 9 of the present configuration needs to be made of a fine inorganic material since it is necessary to prevent the piezoelectric element 15 from being damaged by the film forming and etching processes and to select a material through which the moisture within the atmosphere is difficult to penetrate. An organic material is not suitable since it is necessary to increase the film thickness in order to obtain a sufficient protection performance. This is because an inkjet head with a low ejection performance is yielded since a vibratory displacement of the vibrating plate 3 is inhibited remarkably if the insulating film 9 is made thick.

While it is preferable to use an oxide, a nitride, or a carbide film in order to obtain a high protection performance with a thin film, a material needs to be selected which has a high adhesion with electrode, piezoelectric, and vibrating plate materials which serve as a groundwork for the insulating film. Moreover, also for the film forming method, a film forming method which does not damage the piezoelectric element 15 needs to be selected. In other words, a plasma CVD method in which a reactive gas is converted to plasma to deposit the plasma on a substrate, or a sputtering method in which plasma is made to collide with a target material so as to cause the plasma to sputter, thereby forming a film is not preferable.

While preferable exemplary film forming methods include deposition, an ALD process, etc., the ALD process is suitable which has a wide range of selection of materials which can be used. Preferable exemplary materials include an oxide film which is used for a ceramic material such as $Al_2O_3$, $ZrO_2$, $Y_2O_3$, $Ta_2O_3$, and $TiO_2$.

The film thickness of the insulating film 9 needs to be sufficiently thin to be able to ensure the protection performance of the piezoelectric element 15 and to be as thin as possible so as to not inhibit the displacement of the vibrating plate 3. In other words, in an area other than the dedicated liquid chamber forming area, the above-described preferable film thickness of the insulating film 9 is in a range of 20-100 nm. If it is thicker than 100 nm, the displacement of the vibrating plate 3 drops, yielding an inkjet head with a low ejection efficiency. On the other hand, if it is thinner than 20 nm, a function as a protective layer of the piezoelectric element 15 is insufficient, so that the performance of the piezoelectric element 15 drops as described above.

Now, there is a concern for a characteristic deterioration in piezoelectric characteristics, etc. since a function to achieve sufficient moisture permeation resistance to block moisture within the atmosphere is lost as the film thickness itself becomes small and the insulating film 9 which protects an upper portion of the piezoelectric material 5 is damaged by etching due to the fact that the dedicated liquid chamber forming area is formed as an opening (a dedicated liquid chamber opening) with a flow shown in FIG. 5B.

On the other hand, in the present embodiment, an insulating layer with a low moisture resistance and a small film thickness and other layers are stacked on the upper electrode 6, an opening is formed, after which once again the insulating film 12 with a low moisture permeation and a small film thickness is stacked, thereby making an improvement with respect to the characteristic deterioration, etc., due to moisture within the atmosphere.

As described above, the insulating film 9 has the feature that there is a difference in the film thickness between the dedicated liquid chamber 1 forming area and the other area, and the film thickness of the insulating film 9 which is formed in an area other than the dedicated liquid chamber 1 forming area is larger than the film thickness of a film formed in the dedicated liquid chamber 1. If expressed from a different viewpoint, it may also be said the insulating film 9 has the feature that there is a difference in the film density between the dedicated liquid chamber 1 forming area and the other area, and the film density of a film formed in an area other than the dedicated liquid chamber 1 forming area is larger than the film density of a film formed in the dedicated liquid chamber 1 forming area.

For the insulating film 12 of the configuration according to the present embodiment, the same material, film forming method, and the film thickness range as the above-described insulating film 9 are preferable. Moreover, the insulating film 12 has the feature that there is no difference in the film thickness between the dedicated liquid chamber 1 forming area and the other area. Expressed from a different viewpoint, it may also be said the insulating film 12 has no difference in the film density between the dedicated liquid chamber 1 forming area and the other area.

Moreover, the insulating film 12, which is formed in an area other than the dedicated liquid chamber 1 forming area, has a smaller film thickness difference relative to the insulating film 9. Expressed from a different viewpoint, the insulating film 12 formed in an area other than the dedicated liquid chamber 1 forming area has the feature that it has a smaller film density difference relative to the insulating film 9.

For the insulating film 10 according to the configuration of the present embodiment, while an arbitrary insulating material can be used, it is preferable to use an inorganic material, taking into account adhesion with the dedicated electrode wiring 7 which is formed on the insulating film 10. As the organic material, while an arbitrary oxide, nitride, a carbide, or a composite compound thereof may be used, $SiO_2$, which is commonly used for a semiconductor device, may be used.

An arbitrary scheme may be used for forming the insulating film 10, including, for example, a CVD method, a sputtering method, and the CVD method is preferably used which can isotropically form a film, taking into account step covering of a pattern forming section such as an electrode forming section, etc.

A film thickness of the insulating film 10 needs to be made as a film thickness such as to not undergo dielectric breakdown at a voltage applied to the lower electrode 4 and the dedicated electrode wiring 7. In other words, an electric field strength to be applied to the insulating film 10 needs to be set such as not to undergo a dielectric breakdown. Moreover, taking into account a pin hole, a surface property of the groundwork of the insulating film 10, etc., the film thickness needs to be at least 200 nm and, moreover, is preferably at least 500 nm. Furthermore, as shown in FIGS. 2 and 3, the insulating film 10 has an opening surrounding the piezoelectric element 15. In this way, even when stacking is performed with a film thickness which may ensure insulating withstand pressure, the insulating film 10 of an area which limits an amount of displacement of the vibrating plate 3 is removed, making it possible to reduce an impact on the displacement and to balance between ejection efficiency and reliability.

Moreover, for forming the above-described opening of the insulating film 10, the photolithography method and dry etching can be used as the insulating film 9 is protected by the piezoelectric element 15.

Moreover, the insulating film 10 is formed to make it possible to adopt a structure such that the lower electrode 4 and the dedicated electrode wiring 7 are overlapped via the insulating film 10. In this way, a degree of freedom of drawing a wiring around and arranging an electrode increases, making it possible to efficiently arrange patterns. In other words, a reduced size and an increased density of the inkjet head becomes possible.

The insulating film 11 in the configuration of the present embodiment is a passivation layer which has a function of a protective layer of the common electrode wiring 8 and the dedicated electrode wiring 7. As shown in FIGS. 2 and 3, the insulating film 11 covers over the common electrode and the dedicated electrode except for the dedicated electrode lead section and the common electrode lead section. In this way, Al, which is inexpensive, or an alloy material with Al as a main component may be used for the electrode material. As a result, a low cost and a highly reliable inkjet head may be made. While an arbitrary inorganic material or organic material may be used for a material of the insulating film 11, it needs to be a material with a low moisture permeation. As the inorganic material an oxide, nitride, a carbide, etc., may be exemplified, while as the organic material, polyimide, acrylic resin, urethane resin, etc., may be exemplified.

The organic material needs to be made as a thick film, which is not suitable for the below-described patterning. Therefore, it is preferable to use an inorganic material which may demonstrate a wiring protection function with a thin film. In particular, using $Si_3N_4$ on an Al wiring is preferable since it is a technique with achievements in semiconductor devices. Moreover, it is preferable for the film thickness of the insulating film 11 to be at least 200 nm and it is more preferable for it to be at least 500 nm. When the film thickness is small, a sufficient passivation function is not demonstrated, causing a wire to break due to corrosion of the wiring material and causing a drop in the reliability of the inkjet head.

As shown in FIGS. 2 and 3, the insulating film 11 is structured to have an opening on the piezoelectric element 15 and the vibrating plate 3 surrounding the piezoelectric element 15. This is due to the same reason as the above-described opening of the insulating film 10. In this way, a highly efficient and a highly reliable inkjet head can be yielded.

Below, materials and processes of the respective features of the present invention other than the insulating film are specifically described.

(Liquid Chamber Substrate 2)

As the liquid chamber substrate 2, it is preferable to use a silicon monocrystal substrate, and it is preferable to have a thickness of normally 100-600 μm. As plane directions there are three types of plane directions: (100), (110), and (111); in the semiconductor industry, in general (100) and (111) are used widely, and in the configuration of the present embodiment, a monocrystal substrate which has primarily the (100) plane direction was mainly used. Moreover, when manufacturing the dedicated liquid chamber 1, which is a pressure chamber shown in FIG. 2, etching is utilized to process the silicon monocrystal substrate; for this case, it is common to use anisotropic etching as an etching method. The anisotropic etching utilizes a property that the etching speed differs for the plane directions of the crystal structure. For example, in anisotropic etching for soaking into an alkaline solution such as KOH, the etching speed for the (111) plane is approximately 1/400 of that for the (100) plane. Therefore, it is known that, while a structure having a slope of approximately 54 degrees may be manufactured with the plane direction of (100), a deep trench may be digged with the plane direction of (110), making it possible to increase the alignment density while maintaining rigidity; thus, a monocrystal substrate having the plane direction of (110) can also be used for the configuration of the present embodiment. In this case, for using the monocrystal substrate, it is important to take into account that $SiO_2$, which is a masking material, also becomes etched.

(Groundwork: Vibrating Plate 3)

As shown in FIG. 2, upon receiving a force caused by the piezoelectric material 5, which is an electromechanical conversion film, a groundwork (the vibrating plate 3) deforms and is displaced, ejecting ink of the dedicated liquid chamber as ink droplets. Therefore, it is preferable that the groundwork has a predetermined strength. The material includes Si, $SiO_2$, $Si_3N_4$, fabricated by the CVD method. Moreover, it is preferable to select a material with a linear expansion coefficient which is close to that of the lower electrode 4 as shown in FIG. 2, the electromechanical conversion film. In particular, as the electromechanical conversion film, PZT is commonly used as a material, so that, as a linear expansion coefficient which is close to the linear expansion coefficient of $8\times10^{-6}$ (1/K), a material preferably has the linear expansion coefficient of $5\times10^{-6}$ to $10\times10^{-6}$ (1/K), and more preferably has the linear expansion coefficient of $7\times10^{-6}$ to $9\times10^{-6}$ (1/K). Specific materials, which include aluminum oxide, zirconium oxide, iridium oxide, ruthenium oxide, tantalum oxide, hafnium oxide, osmium oxide, rhenium oxide, rhodium oxide, palladium oxide, and a compound thereof, etc, may be manufactured with a spin coater using a Sol-gel method (below abbreviated as "Sol-gel") or the sputtering method.

The film thickness is preferably 0.1-10 μm and more preferably 0.5-3 μm. If it is smaller than the above-described ranges it is difficult to process a pressure chamber (the dedicated liquid chamber 1) as shown in FIG. 2, while, if it is larger than the above-described ranges, it is less likely for the groundwork (the vibrating plate 3) to deform and be displaced, so that ejection of the ink droplets becomes unstable.

(Lower Electrode 4)

When a complex oxide containing lead is used as the electromechanical conversion film, reaction with lead in the lower electrode 4, or diffusion occurs, possibly causing deterioration in the piezoelectric characteristics. Therefore, an electrode material is needed which has barrier properties with respect to the reaction with lead, or the diffusion.

In the configuration of the present embodiment, it is deemed effective to use conductive oxides for the electrode. More specifically, the complex oxides, which are described with a chemical formula $ABO_3$ and which have A=Sr, Ba, Ca, La; B=Ru, Co, Ni as main components, include $SrRuO_3$, $CaRuO_3$; $(Sr_{1-X}Ca_X)O_3$, which is a solid solution thereof; as well as $LaNiO_3$, $SrCoO_3$, and $(La,Sr)(Ni_{1-y}Co_y)O_3$ (may be y=1), which is a solid solution thereof. Other oxide materials also include $IrO_2$, $RuO_2$.

Moreover, the above-described conductive oxide electrode is stacked after manufacturing a metal electrode for ensuring electric conductivity. Metal electrode materials include platinum group elements of Ru, Rh, Pd, Os, Ir, and Pt that are known to have high heat resistance and low reactivity, and alloy materials which include these platinum group elements.

Moreover, as adhesion with the groundwork ($SiO_2$ in particular) is poor, it is preferable to start stacking with Ti, $TiO_2$, TiN, Ta, $Ta_2O_5$, $Ta_3N_5$, etc.

As a method of manufacturing, the sputtering method or the Sol-gel method may be used to perform manufacturing using the spin coater.

(Piezoelectric Material 5)

In the configuration of the present embodiment, PZT is mainly used. PZT, which is a solid solution of lead zirconate ($PbZrO_3$) and titanic acid ($PbTiO_3$), differs in the characteristics according to the ratio thereof. A composition which demonstrates a generally superior piezoelectric characteristic is a ratio between $PbZrO_3$ and $PbTiO_3$ of 53:47, which shown in a chemical formula is $Pb(Zr0.53,Ti0.47)O_3$, common PZT (53/47). Complex oxides other than PZT includes barium titanate, etc.; in this case, using barium alkoxide and titanium alkoxide compounds as starting materials, a barium titanate precursor solution can also be manufactured by dissolving them in a common solvent.

Complex oxides with A=Pb, Ba, Sr; B=Ti, Zr, Sn, Ni, Zn, Mg, Nb apply to such materials described with a general formula $ABO_3$. A specific description may be $(Pb_{1-x},Ba)(Zr,Ti)O_3$, $(Pb1-X,Sr)(Zr,Ti)O_3$, which is a case in which Pb in site A is partially replaced by Ba and Sr. Such replacement is possible for a bivalent element, the effect of which is that an action of reducing characteristic deterioration due to evaporation of lead during the thermal process is demonstrated.

As a method of manufacturing, the sputtering method or the Sol-gel method may be used to perform manufacturing with the spin coater. In that case, patterning is needed; thus, a desired pattern is obtained by photolithographic etching, etc.

When PZT is manufactured with a Sol-gel method, using lead acetate, zirconium alkoxide and titanium alkoxide compounds as starting materials, a uniform solution may be obtained by dissolving them in methoxy ethanol as a common solvent to manufacture a PZT precursor solution. The metal alkoxide compounds easily hydrolyze by moisture in the atmosphere, so that an appropriate amount of stabilizers such as acetyl acetone, acetic acid, diethanolamine, etc., may be added in the PZT precursor solution.

When a PZT film is to be obtained on the whole face of a groundwork substrate, a solution applying method such as spin coating is used to form a coating film and apply the respective thermal processes of solvent drying, thermolysis, and crystallization. Metamorphosis from the coating film to a crystallized film involves volume shrinkage, so that, in order to obtain a crack-free film, adjustment of a PZT precursor concentration is needed in order to obtain a film thickness of no more than 100 nm in a one-time step.

(Upper Electrode 6)

In a manner similar to the configuration of the lower electrode 4, it is effective to use a conductive oxide as an electrode. More specifically, the complex oxides, which are described with a chemical formula $ABO_3$ and which have A=Sr, Ba, Ca, La; B=Ru, Co, Ni as main components, include $SrRuO_3$, $CaRuO_3$; $(Sr_{1-x}Ca_x)O_3$, which is a solid solution thereof; as well as $LaNiO_3$, $SrCoO_3$, and $(La,Sr)(Ni_{1-y},Co_y)$ O3 (may be Y=1), which is a solid solution thereof.

Other oxide materials also include $IrO_2$, $RuO_2$. Moreover, in order to supplement the wiring resistance, it is also effective to use an Ag alloy, Cu, Al, Au as well as platinoid elements and alloy films thereof, such as platinum, iridium, platinum-rhodium on a conductive oxide.

The sputtering method or the Sol-gel method may be used as a method of manufacturing to perform manufacturing with the spin coater. In that case, patterning is needed; thus, a desired pattern is obtained by photolithographic etching, etc.

(Lead Wiring 18)

It is preferably a metal electrode material made of any one of an Ag alloy, Cu, Al, Au, Pt, and Ir. The sputtering method or the spin coating method is used for manufacturing, after which a desired pattern is obtained by photolithographic etching. Moreover, the groundwork surface may be partially surface reformed to manufacture a film patterned by an inkjet process. For manufacturing using the inkjet process, a patterned film may be obtained with the same manufacturing flow as in the second electrode. For the surface reforming material, a silicon analogue is mainly selected when the groundwork (the insulating protective layer) is an oxide. Moreover, for an organic substance such as polyimide (PI), ultra violet rays may be irradiated thereon to increase the surface energy of an area irradiated. As a result, an inkjet process may be used to directly draw a third or a fourth high-definition electrode pattern on an area with an increased surface energy. Moreover, polyimide, with a small surface energy, can be used to high-definition pattern an inorganic semiconductor layer. As polymeric materials which make it possible to increase the surface energy with the ultraviolet rays, a material disclosed in JP2006-060079A may be used.

Moreover, below-described commercially available paste materials may be used to obtain an electrode film with screen printing: Perfect Gold (registered trademark) (gold paste, a product name of Shinku Yakin KK); Perfect Copper (copper paste, a product name of Shinku Yakin KK); Orgacon Paste variant 1/4 and Paste variant 1/3 (transparent PEDOT/PSS ink for printing, product names of Agfa-Gevaert Japan); Orgacon Carbon Paste variant 2/2 (carbon electrode paste, a product name of Agfa-Gevaert Japan), BAYTRON (registered trademark), P (PEDT/PSS aqueous solution, a product name of Nihon Starck-V TECH). As the film thickness, 0.1-20 μm is preferable and 0.2-10 μm is more preferable. If it is smaller than the above ranges, it is not possible to cause a sufficient amount of current to flow through an electrode as resistance becomes large, so that head ejection becomes unstable, whereas if it is larger than the above ranges, the process time becomes long.

Below, Examples 1-4 of the present invention are described in detail, while comparing with below-described Comparative Examples as needed.

EXAMPLE 1

A thermal oxide film (with a film thickness of 1 micron) is formed on a silicon wafer, and, as a lower electrode, a titanium film (with a film thickness of 50 nm), a platinum film (with a film thickness 200 nm), and an SrRuO film (with a film thickness of 100 nm) are formed by sputtering. The titanium film serves as a cohesive layer between the thermal oxide layer and the platinum layer. Next, as an electromechanical conversion film, a film of PZT(53/47) is formed by spin coating. For synthesizing a PZT precursor applying solution, lead acetate trihydrate, titanium isopropoxide, and zirconium isopropoxide may be used. Combined water of lead acetate dissolves in methoxyethanol, after which it dehydrates. An amount of lead relative to the stoichiometric composition is arranged to be 10 mol % excess. This is to prevent a drop in crystallinity due to a so-called lead drop during the thermal process. Titanium isopropoxyde and zirconium isopropoxide are dissolved in methoxyethanol, subjected to an alcohol exchange reaction and an esterification reaction, and mixed with a methoxyethahnol solution in which is dissolved the above-described lead acetate to synthesize the PZT precursor solution. The PZT concentration is arranged to be 0.5 mol/liter. After film forming with spin coating, three rounds of a process from drying at 120 degrees Celsius to thermolysis at 500 degrees Celsius were carried out, after which a crystallization thermal process were carried out at a temperature of 700 degrees Celsius in a rapid thermal process (RTA). No failures such as cracks occurred in the film. The film thickness measured after carrying out four rounds of the process up to the crystallization thermolysis (in other words, carrying out the applying process 12 times) reached 1000 nm.

Next, as an upper electrode, an SrRuO film (with the film thickness of 100 nm), and a platinum film (with the film thickness of 100 nm) are formed by sputtering. Thereafter, a film of a photoresist (TSMR8800) made by Tokyo Ohka Kogyo, Co., Ltd., is formed by spin coating, a resist pattern is formed by conventional photolithography, after which patterns as shown in FIGS. 2 and 3 are made using an ICP etching apparatus (manufactured by SAMCO Inc.).

Next, as the insulating film 9, a 50 nm of $Al2O_3$ film is formed using an ALD process. Here, as raw materials, TMA (Sigma-Aldrich) for Al (aluminum) and $O_3$ generated by an ozone generator for O (oxygen) are alternately stacked to subject them to film forming.

Next, as the insulating film 10, a plasma CVD is used to form a 500 nm of $SiO_2$ film. Thereafter, as shown in FIG. 4B, the contact holes 16 and 17 are formed by etching. Thereafter, as a wiring electrode, a film of Al is formed by sputtering, which is subjected to pattern forming by etching, after which, as the insulating film 11, a 1000 nm film of SiN is formed using plasma CVD. Thereafter, as shown in FIG. 5B, in order to provide an opening at a dedicated liquid chamber forming area (dedicated liquid chamber opening), the insulating film 11 and the insulating film 10 are successively etched. Thereafter, as the insulating film 12, a 50 nm of $Al_2O_3$ film is formed using an ALD process. Thereafter, as shown in FIG. 5C, openings at PAD sections 12*a* and 12*b* for taking out the dedicated electrode wiring 7 or the common electrode wiring 8 are provided, and a part of an inkjet head (an element) as shown in FIGS. 2 and 3 is formed.

EXAMPLE 2

Other than forming a 20 nm film of $Al_2O_3$ of the insulating films 9 and 12, an inkjet head (element) is manufactured as in Example 1.

EXAMPLE 3

Other than forming a 100 nm film of $Al_2O_3$ of the insulating films 9 and 12, an inkjet head (element) is manufactured as in Example 1.

EXAMPLE 4

As in Example 1, after forming up to the insulating film 9, a 1000 nm film of SiN is formed using plasma CVD.

Figure 6:
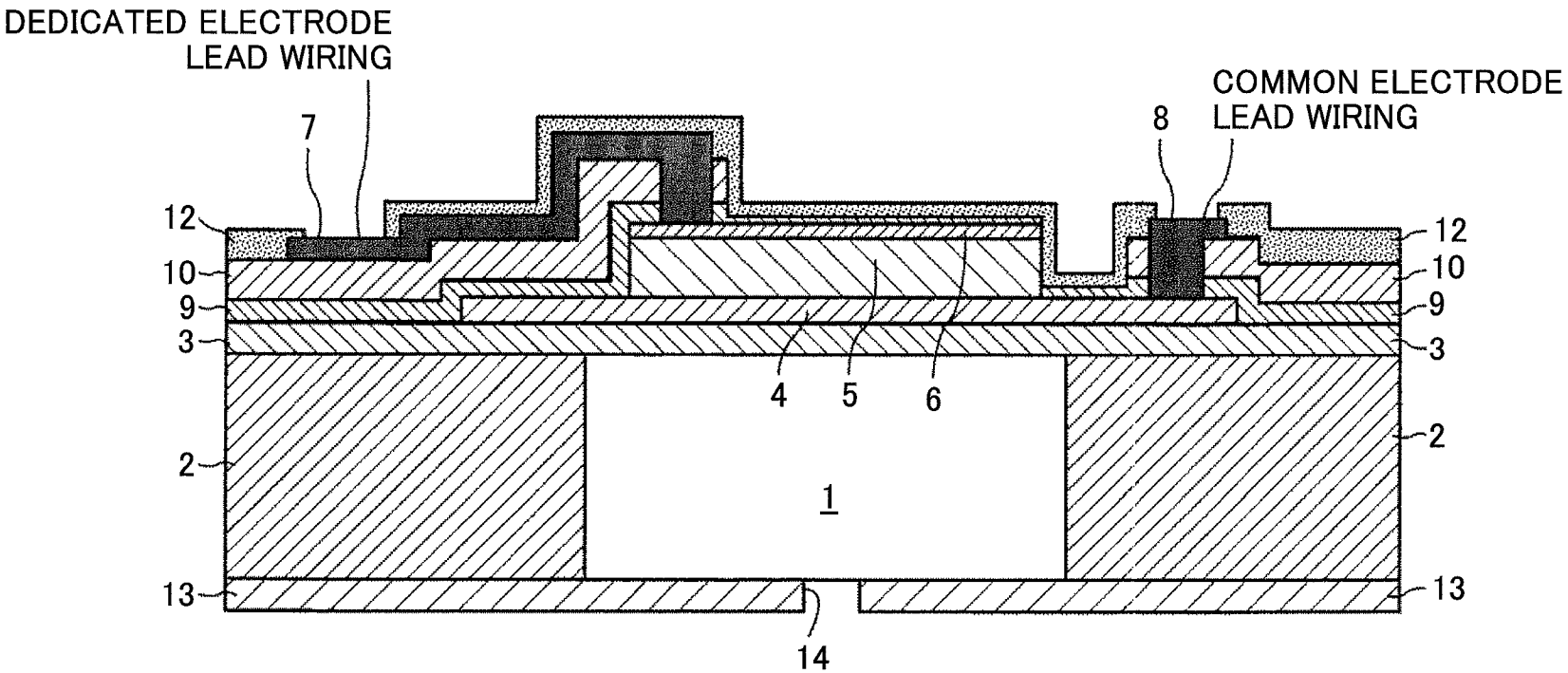
FIG. 6 is a cross-sectional diagram of a main part of the inkjet head in Example 4.

Thereafter, as shown in FIG. 6, a contact hole is formed by etching. Thereafter, as a wiring electrode, a film of Al is formed by sputtering, which is subjected to pattern forming by etching. Thereafter, in order to provide an opening at a dedicated liquid chamber forming area, only the insulating film 10 is etched. Thereafter, as the insulating film 12, a 50 nm film of $Al_2O_3$ is formed using an ALD process. Thereafter, an opening is provided at a PAD section for taking out the dedicated electrode wiring 7 or the common electrode wiring 8, and a part of the inkjet head (element) shown in FIG. 6 is formed.

As described above, in Example 4, the insulating film is formed such that it includes substantially a three-layer structure, wherein the insulating film 11 (the third insulating film) in Examples 1-3 is not formed.

COMPARATIVE EXAMPLE 1

Other than not forming the insulating film 12, an inkjet head (element) as in Example 1 is manufactured.

COMPARATIVE EXAMPLE 2

Other than forming a 10 nm film of $Al_2O_3$ of the insulating films 9 and 12, an inkjet head (element) is manufactured as in Example 1.

COMPARATIVE EXAMPLE 3

Other than forming a 150 nm film of $Al_2O_3$ of the insulating films 9 and 4, an inkjet head (element) is manufactured as in Example 1.

COMPARATIVE EXAMPLE 4

Figure 7:
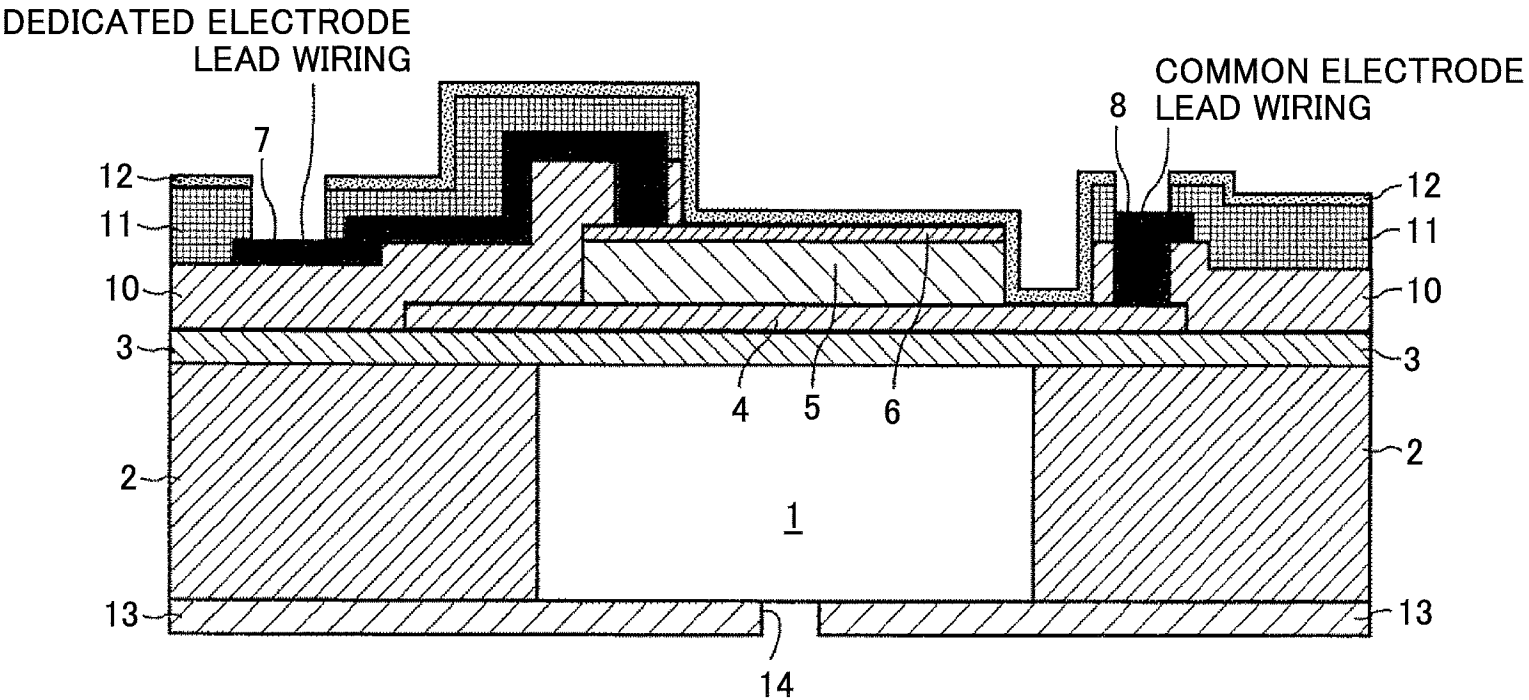
FIG. 7 is a cross-sectional diagram of a main part of the inkjet head in Comparative example 4.

As in Example 1, after forming up to the upper electrode 6, a 500 nm film of $SiO_2$ is formed using plasma CVD. Thereafter, as shown in FIG. 7, a contact hole is formed by etching. Thereafter, as a wiring electrode, a film of Al is formed by sputtering, which is subjected to pattern forming by etching. Thereafter, in order to provide an opening at a dedicated liquid chamber forming area, only the insulating film 10 is etched. Thereafter, as the insulating film 12, a 50 nm film of $Al_2O_3$ is formed using an ALD process. Thereafter, an opening is provided at a PAD section for taking out the dedicated electrode wiring 7 or the common electrode wiring, and a part of the inkjet head (element) shown in FIG. 7 is formed.

COMPARATIVE EXAMPLE 5

Other than forming a 200 nm film of $Al_2O_3$ of the insulating film 9, an inkjet head (element) is manufactured as in Comparative Example 1.

Electrical characteristics of the inkjet heads (below called "elements") which were manufactured in Examples 1-4 and Comparative Examples 1-5 were evaluated. Thereafter, as a reliability testing, the elements were left in an environment of 80 degrees Celsius and a relative humidity of 85% for 100 hours, after which they were subjected to an electric characteristic evaluation in the atmosphere. Moreover, besides the elements for electric characteristic evaluation, an element was manufactured, which element resulting in a liquid ejection head through an etching removal from a back face for forming a pressure chamber, and bonding of a nozzle plate having a nozzle hole. An apparatus for ejection testing evaluation shown in FIG. 8 was manufactured and ejection evaluation of ink (liquid) was performed. Using ink which is adjusted to have the viscosity of 5 cp, an ejection condition was checked when a voltage of −10 to −30 V was applied with a simple Push waveform, checking for whether ejection was possible. Results of the above-described electric characteristic testing and ejection results are shown in Table 1 below.

Figure 8:
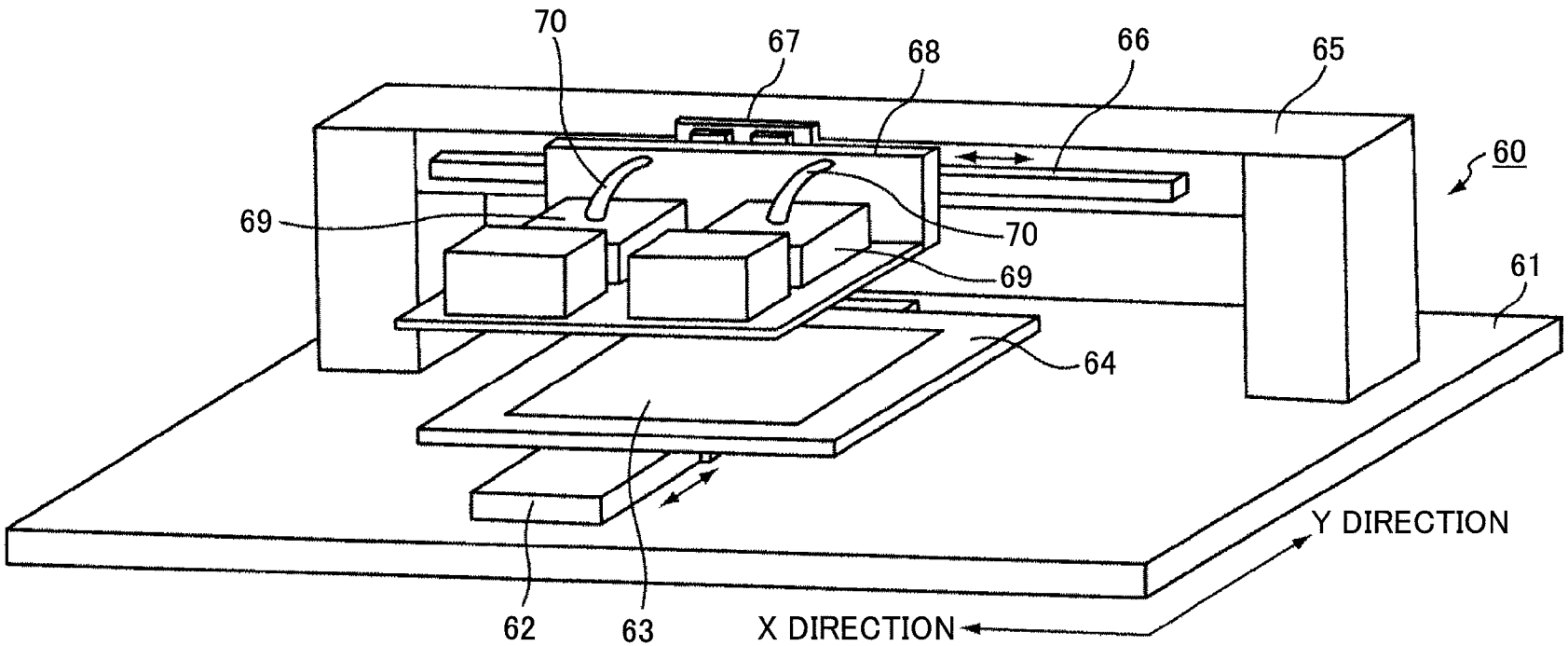
FIG. 8 is a perspective view illustrating one example of an apparatus used for an ejecting test with inkjet heads in Examples 1-4 and Comparative Examples 1-5 being installed.

FIG. 8 is a perspective view illustrating one example of an apparatus used for an ejection testing with inkjet heads in the above-described Examples 1-4 and Comparative Examples 1-5 being installed. An ink (liquid droplet) ejection apparatus 60 has a Y-axis drive unit 62 installed on a platform 61, above which Y-axis drive unit 62 a stage 64 which has installed thereon a substrate 63 is installed such that the stage 64 may drive in a Y-axis direction. The stage 64 has provided thereon accompanying elements of an adsorbing unit which adsorbs static electricity, a vacuum (not shown), etc. Moreover, at an X-axis supporting member 65 is installed an X-axis drive unit 66, at which X-axis drive unit 66, a head base 68 is installed on a Z-axis drive unit 67, the head base 68 being arranged to move in an X-axis direction. On the head base 68 is installed an inkjet head 69 which ejects ink. To the inkjet head 69, ink is supplied via a supplying pipe 70 from a liquid (ink) tank (not shown).

The ejection testing was conducted under the same testing conditions for the Examples 1-4 and the Comparative Examples 1-5. Below, specific conditions are listed. The apparatus in FIG. 8 was used for carrying out the ejection testing in a stationary state without moving in the X, Y, or Z direction primarily for ensuring the same ejection testing conditions.

Ink ejection speed: 7±1 m/sec

Applied voltage: 15 V:

TABLE 1

| | Ps (BEFORE TESTING) | Ps (AFTER TESTING) | EJECTION TESTING |
|---|---|---|---|
| EXAMPLE 1 | 47 | 47 | OK |
| EXAMPLE 2 | 48 | 48 | OK |
| EXAMPLE 3 | 46 | 45 | OK |
| EXAMPLE 4 | 47 | 46 | OK |
| COMPARATIVE EXAMPLE 1 | 47 | 31 | OK |
| COMPARATIVE EXAMPLE 2 | 32 | 25 | NG |
| COMPARATIVE EXAMPLE 3 | 48 | 48 | NG |
| COMPARATIVE EXAMPLE 4 | 20 | 19 | NG |
| COMPARATIVE EXAMPLE 5 | 49 | 39 | OK |

Figure 9:
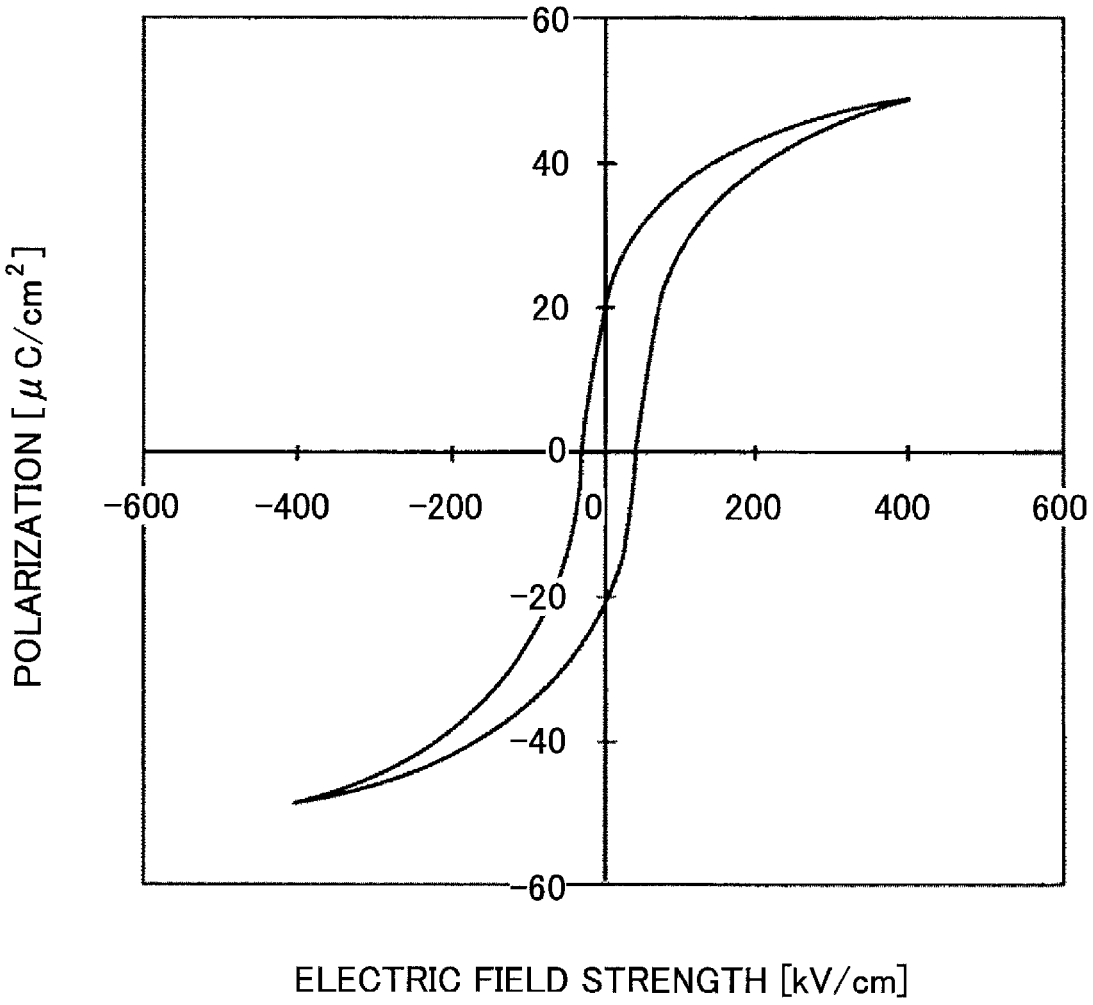
FIG. 9 is a graph illustrating one example of a P-E hysteresis curve.

FIG. 9 shows representative P-E hysteresis curve results as electric characteristic results. Values of Ps (saturated polarization) at an electric field strength of 150 kV/cm are shown in Table 1 below.

As shown in Table 1, looking at the electric characteristic results before the reliability testing, as the film thickness of the insulating film 9 is not sufficiently large in Comparative Examples 2 and 4, a damage in the process of forming films of $SiO_2$ and SiN as the insulating film 10 (the second insulating film) and the insulating film 11 (the third insulating film) is subjected to, largely deteriorating compared to the other samples. It is seen that the electric characteristic results after the reliability testing in Comparative Example 1 show significant changes before and after the reliability testing and deterioration in the characteristics. It is seen that Comparative Examples 2 and 5 show changes before and after the reliability testing and a small deterioration in the characteristics. As a result that a function of a film of $Al_2O_3$ that is manufactured as the insulating film 9 (the first insulating film) to achieve sufficient moisture permeation resistance to block moisture in the atmosphere was lost due to an etching damage at the time of providing an opening at the dedicated liquid chamber forming area, the piezoelectric element 15 was damaged by the moisture, so that the characteristic deteriorated between a time before the reliability testing and a time after the reliability testing.

Looking at the ejection results, for the Comparative Examples 2 and 4, no sufficient values were obtained even with initial electric characteristics, and the ejection results were obtained that were also insufficient. For the comparative Example 3, a total amount of a film of $Al_2O_3$ that is formed in the dedicated liquid chamber forming area (a total film thickness of the insulating film 9 and the insulating film 12 (the fourth insulating film)) is large, causing an inability to ensure a sufficient amount of displacement of the vibrating plate 3, so that the ejection is insufficient.

As described above, in addition to the advantages and effects stated in the above explanations, the present embodiments and Examples 1-4 prevent deterioration of a piezoelectric material due to moisture within the atmosphere and plasma in a semiconductor process and increase an amount of displacement of a piezoelectric element and, at the same time, eliminate constraints of wiring, such as a dedicated electrode, etc., to maintain an injection head which may be made highly dense, or in other words, maintain high reliability (moisture resistance) and superior ejection characteristics while realizing and providing a small-sized inkjet head.

Figure 10:
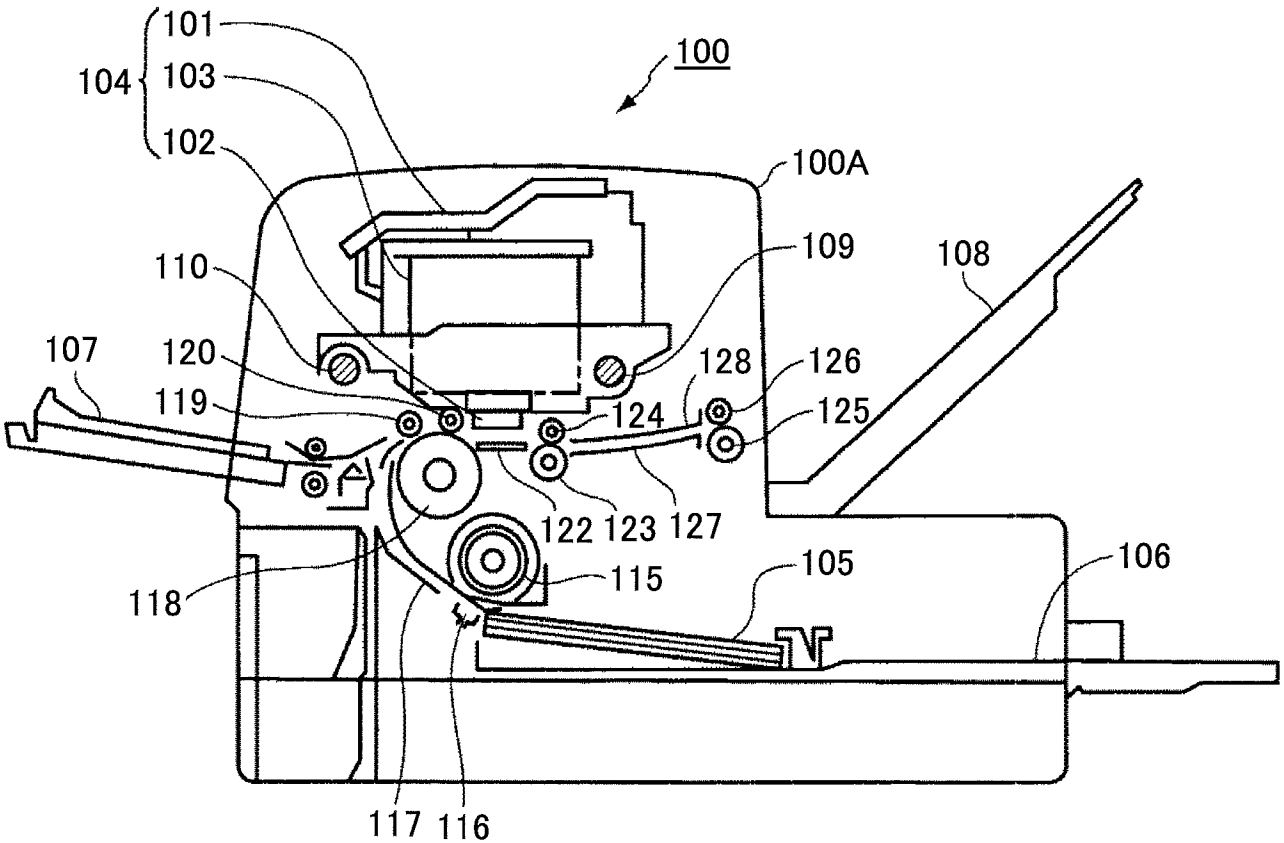
FIG. 10 is a partially-sectioned front schematic view of a machinery unit of an inkjet recording apparatus of the present invention.
Figure 11:
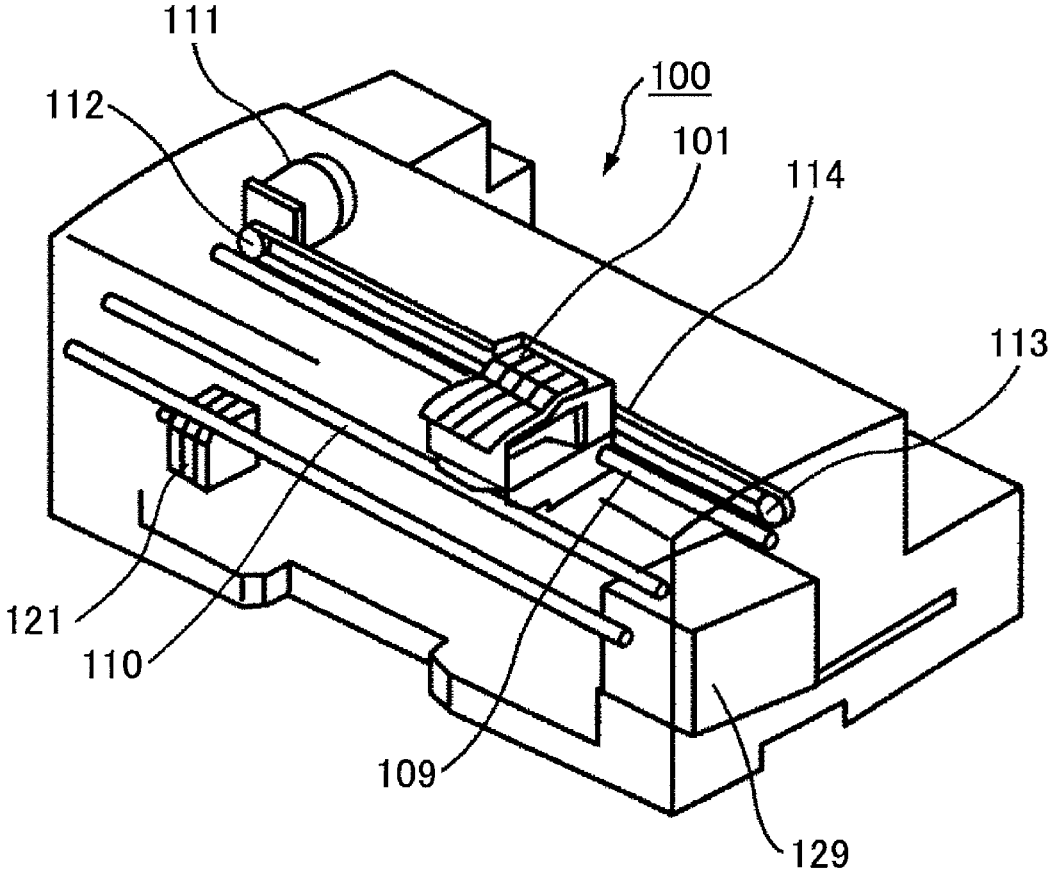
FIG. 11 is a perspective schematic view which sees through a main part of the inkjet recording apparatus in FIG. 10.

With reference to FIGS. 10 and 11, an example of the inkjet recording apparatus having installed thereon an inkjet head according to the present invention is described. FIG. 10 is a partially-sectioned front schematic view of a machinery unit of the inkjet recording apparatus of the present invention, and FIG. 11 is a perspective schematic view which sees through a main part of the inkjet recording apparatus.

An inkjet recording apparatus 100 according to the present invention that is shown in FIGS. 10 and 11 has installed thereon an inkjet head of the above-described embodiments and Examples 1-4.

The inkjet recording apparatus 100, which is a so-called serial-type inkjet recording apparatus, includes a carriage 101 inside a recording apparatus body 100A, the carriage 101 being moveable in the main scanning direction; and a print machinery unit 104 which includes a recording head 102, which includes an inkjet head manufactured in accordance of an embodiment of the present invention, the inkjet head installed on the carriage 101, and an ink cartridge 103 which supplies ink to the recording head 102.

At a lower portion of the recording apparatus body 100A are provided a paper-feeding cassette 106 which can be loaded with a large number of sheets 150 from a front side on the left side in FIG. 10 and also provided a manual tray 107 for manually feeding a sheet 105 such that it may be opened and put down. Taking in the sheet 105 fed from the paper-feeding cassette 106 or the manual tray 107, the print machinery unit 104 records required images, after which it conducts sheet discharging onto a paper-discharging tray 108 mounted on the back face side.

The print machinery unit 104 holds the carriage 101 with a main guiding rod 109 and a sub guiding rod 110, which are guiding members laterally bridged across left and right side plates (not shown), such that it is slidable in the main scanning direction; in the carriage 101 are mounted recording heads 102 with ink droplet ejection direction facing downwards and with multiple ink ejecting outlets (nozzles) being aligned in a direction which cross the main scanning direction, the recording heads 102 including inkjet heads according to the present invention that eject ink droplets of each color of yellow (Y), cyan (C), magenta (M), and black (Bk).

The carriage 101 has replaceably mounted each ink cartridge 103 for supplying ink of each color to the recording head 102. The ink cartridge 103, which includes, at an upper portion thereof, an atmospheric channel which communicates with the atmosphere; includes, at a lower portion thereof, a supplying outlet which supplies ink to the recording head 102; includes, inside thereof, a multiporous material in which ink is filled, maintains ink to be supplied to the recording head 102 to a slightly negative pressure by capillary force of the multiporous material. Moreover, while heads of each color are used here as the recording head 102, it may be one head which has nozzles ejecting ink droplets of respective colors. Here, the carriage 101 slidably fits the rear side (the downstream side in the sheet conveying direction) thereof in the main guiding rod 109 and slidably puts the front side (the upstream side of the sheet conveying direction) on the sub guiding rod 110. Then, in order to move and scan this carriage 101 in the main scanning direction, a timing belt 104 is stretched between a drive pulley 112 and a follower pulley 113 that are rotationally driven by a main scanning motor 111; the timing belt 104 is fixed to the carriage 101, and is driven in both ways by rotation of the main scanning motor 111 in normal and reverse directions.

In the mean time, in order to convey the sheet 105 set in the paper-feeding cassette 106 to the lower side of the recording head 102, there are provided a paper-feeding roller 115 and a friction pad 116 that separately send the sheet 105 from the paper-feeding cassette 106; a guide member 117 which guides the sheet 105; a conveying roller 118 which convey the fed sheet 105 such that it is reversed; a conveying roller 119 which is pushed against a peripheral face of the conveying roller 118; and a tip roller 120 which specifies an angle of sending out the sheet 105 from the conveying roller 118.

The conveying roller 118 is rotationally driven via a row of gears by a sub-scanning motor (not shown). Then, there is provided an image receiving member 122, which is a sheet guiding member which guides, on the lower side of the recording head 102, the sheet 105 sent out from the conveying roller 118 in correspondence with a moving range of the carriage 101 in the main scanning direction. There are provided, on the downstream side of the image receiving member 122 in the sheet conveying direction, a conveying roller 123 and a spur 124 that are rotationally driven for sending out the sheet 105 in a paper-discharging direction; a paper-discharging roller 125 and a spur 126 which send out the sheet 105 to the paper-discharging tray 108; and guiding members 127 and 128 which form a paper-discharging path.

At the time of recording, the recording head 102 is driven according to an image signal while moving the carriage 101 to discharge ink onto sheets 105 at rest to record what amounts to one line, and the following line is recorded after the sheets 105 are conveyed for a predetermined amount. When a recording termination signal or a signal that a trailing edge of the sheet 105 has reached a recording area is received, the recording operation is terminated, so that the sheet 105 is discharged. Moreover, at a position which is off the recording area on the right end side in a moving direction of the carriage 101 is provided a recovery apparatus 129 for recovering an ejection failure of the recording head 102. The recovery apparatus 129 has a cap unit, an adsorbing unit, and a cleaning unit. During the time of waiting for a print, the carriage 101 is moved to the recovery apparatus 129 side and has the recording head capped with a capping unit, preventing an ejection failure due to drying of ink by maintaining an ejecting outlet in a wet state. Moreover, ink which is not involved in recording is ejected at a time such as in the middle of recording, making the viscosity of ink at the ejecting outlet constant, and maintaining a stable ejection performance.

When the ejection failure occurs, the ejecting outlet (nozzle) of the recording head 102 is sealed with the capping unit, foam, etc., are drawn out together with ink from the ejecting outlet by the adsorbing unit via a tube, and ink, waste, etc., that are adhered to a face of the ejecting outlet are removed by the cleaning unit, recovering the ejection failure. Moreover, the adsorbed ink is discharged to a waste ink reservoir (not shown) provided at a lower portion of the body, and is absorbed and maintained in an ink absorbing body within the waste ink reservoir.

As described, the inkjet recording apparatus 100 has installed thereon an inkjet head manufactured according to the Examples 1-4 of the present invention, so that there is no ink droplet ejection failure due to a drive failure of the vibrating plate 3, a stable ink droplet ejection characteristic is obtained, so that image quality is improved.

As described above, the present invention is described for specific embodiments. However, techniques disclosed by the invention are not to be limited to those exemplified in the respective embodiments, including the above-described Examples, so that they may be configured by appropriately combining them. Thus, it is clear to a skilled person that embodiments, variations, or examples may be configured depending on the need and use, etc., within the scope of the present invention.

The scope of application of the present invention is not limited to a micro-ink ejecting inkjet head, so that, in lieu of the ink, it may be a liquid ejecting head which ejects an arbitrary micro liquid which is used depending on the use, Moreover, it is a matter of course that the present invention may also be applicable to a patterning apparatus, etc., using a liquid ejecting head.

The image forming apparatus according to the present invention is not limited to the inkjet recording apparatus 100 shown in FIGS. 10 and 11, so that it may also be applicable to an image forming apparatus including an inkjet type image forming apparatus which has installed thereon the above-described embodiment or examples 1-4 of the present invention. In other words, for example, it may also be applicable to an image forming apparatus which includes an inkjet recording apparatus in a printing apparatus including a printer, a plotter, a word processor, a facsimile machine, a copying machine, a screen printer machine, and a multi-functional machine which includes at least two of the functions as described above.

Moreover, a medium or sheet to be recorded is not limited to a sheet 150, so that all recording media and sheets on which image can be formed using an inkjet are to be included, such as a thin paper which is available for use as described above, a thick paper, a post card, an envelope, and an OHP sheet.

The present application is based on Japanese Priority Application No. 2011-061637 filed on Mar. 18, 2011, the entire contents of which are hereby incorporated by reference.

The invention claimed is:

1. An inkjet head, wherein a vibrating plate is formed on a liquid chamber substrate on which multiple dedicated liquid chambers are aligned, each one of the dedicated liquid chambers being partitioned from the respectively neighboring one of the dedicated liquid chambers by a partition wall, and wherein a piezoelectric element is formed on the side facing the dedicated liquid chambers on the vibrating plate, the piezoelectric element including a lower electrode, a piezoelectric material, and an upper electrode, the inkjet head to be pulled out to a drive signal input section with a dedicated electrode wiring which is in conductive communication with the upper electrode; wherein a first insulating film and a second insulating film are formed between the dedicated electrode wiring and the lower electrode at least in an area in which the dedicated electrode wiring and the lower electrode overlap; wherein a third insulating film and a fourth insulating film are stacked in an area which includes a forming area of the dedicated electrode wiring except the drive signal input section; wherein, in at least a portion of a forming area of the dedicated liquid chambers, there is provided a non-film forming area in which the second insulating film and the third insulating film are not formed, or in which the first insulating film and the second insulating film and the third insulating film are not formed; and wherein, in an area including a piezoelectric element forming section, either the first insulating film and the fourth insulating film are formed in the non-film forming area in which the second insulating film and the third insulating film are not formed, or the fourth insulating film is formed in the non-film forming area in which the first insulating film and the second insulating film and the third insulating film are not formed.

2. The inkjet head as claimed in claim 1, wherein, with respect to the first insulating film, there is a film thickness difference between the forming area of the dedicated liquid chambers and the other area;

and wherein a film thickness of the first insulating film which is formed in an area other than the forming area of the dedicated liquid chambers is larger than a film thickness of the first insulating film which is formed in the forming area of the dedicated liquid chambers.

3. The inkjet head as claimed in claim 1, wherein, with respect to the fourth insulating film, there is no film thickness difference between the forming area of the dedicated liquid chambers and the other area.

4. The inkjet head as claimed in claim 1, wherein, with respect to the first insulating film, there is a film thickness difference between the forming area of the dedicated liquid chambers and the other area; and wherein a film density of the first insulating film which is formed in an area other than the forming area of the dedicated liquid chambers is larger than the film density of the first insulating film formed in the forming area of the dedicated liquid chambers.

5. The inkjet head as claimed in claim 1, wherein, with respect to the fourth insulating film, there is no film thickness difference between the forming area of the dedicated liquid chambers and the other area.

6. The inkjet head as claimed in claim 1, wherein a film thickness difference of the fourth insulating film between the forming area of the dedicated liquid chambers and the other area is less than a film thickness difference of the first insulating film between the forming area of the dedicated liquid chambers and the other area.

7. The inkjet head as claimed in claim 1, wherein a film density difference of the fourth insulating film between the forming area of the dedicated liquid chambers and the other area is less than a film density difference of the first insulating film between the forming area of the dedicated liquid chambers and the other area.

8. The inkjet head as claimed in claim 1, wherein the first insulating film and the fourth insulating film are made of the same material.

9. The inkjet head as claimed in claim 1, wherein the first to the fourth insulating films are formed by a vapor deposition process.

10. The inkjet head as claimed in claim 1, wherein the first insulating film and the fourth insulating film are formed using an ALD process.

11. The inkjet head as claimed in claim 1, wherein, in an area other than the forming area of the dedicated liquid chambers, the first insulating film and the fourth insulating film are between 20 nm and 100 nm.

12. An inkjet recording apparatus which has installed thereon the inkjet head as claimed in claim 1.

13. A liquid droplet ejecting apparatus which has installed thereon the inkjet head as claimed in claim 1.

14. An image forming apparatus which has installed thereon the inkjet head as claimed in claim 1.

15. An image forming apparatus which has installed thereon the inkjet recording apparatus as claimed in claim 12.

16. An image forming apparatus which has installed thereon the liquid droplet ejecting apparatus as claimed in claim 13.

17. An inkjet head, wherein a vibrating plate is formed on a liquid chamber substrate on which multiple dedicated liquid chambers are aligned, each one of the dedicated liquid chambers being partitioned from the respectively neighboring one of the dedicated liquid chambers by a partition wall, and wherein a piezoelectric element is formed on the side facing the dedicated liquid chambers on the vibrating plate, the piezoelectric element including a lower electrode, a piezoelectric material, and an upper electrode, the inkjet head to be pulled out to a drive signal input section with a dedicated electrode wiring which is in conductive communication with the upper electrode; wherein a first insulating film and a second insulating film are formed between the dedicated electrode wiring and the lower electrode at least in an area in which the dedicated electrode wiring and the lower electrode overlap; wherein a fourth insulating film is stacked in an area which includes a forming area of the dedicated electrode wiring except the drive signal input section; wherein, in at least a portion of a forming area of the dedicated liquid chambers, there is provided a non-film forming area in which the second insulating film is not formed, or in which the first insulating film and the second insulating film are not formed; and wherein, in an area including a piezoelectric element forming section, either the first insulating film and the fourth insulating film are formed in the non-film forming area in which the second insulating film is not formed, or the fourth insulating film is formed in the non-film forming area in which the first insulating film and the second insulating film are not formed.

* * * * *